US007541579B2

(12) United States Patent
Konenkov et al.

(10) Patent No.: US 7,541,579 B2
(45) Date of Patent: Jun. 2, 2009

(54) LINEAR QUADRUPOLES WITH ADDED HEXAPOLE FIELDS AND METHOD OF BUILDING AND OPERATING SAME

(75) Inventors: Nikolai Konenkov, Ryazan (RU); Frank Londry, Omemee (CA); Chuanfan Ding, Vancouver (CA); Donald J. Douglas, Vancouver (CA)

(73) Assignees: The University of British Columbia, Vancouver (CA); MDS Analytical Technologies, a business unit of MDS Inc., Concord (CA)

( * ) Notice: Subject to any disclaimer, the term of this patent is extended or adjusted under 35 U.S.C. 154(b) by 295 days.

(21) Appl. No.: 11/703,478

(22) Filed: Feb. 7, 2007

(65) Prior Publication Data

US 2007/0272853 A1 Nov. 29, 2007

Related U.S. Application Data

(60) Provisional application No. 60/771,255, filed on Feb. 7, 2006.

(51) Int. Cl.
*H01J 49/42* (2006.01)

(52) U.S. Cl. ..... 250/292; 250/281; 250/282; 250/288; 250/290; 250/293

(58) Field of Classification Search ..... 250/281, 250/282, 288, 290, 292, 293, 396 R
See application file for complete search history.

(56) References Cited

U.S. PATENT DOCUMENTS 7,141,789 B2 * 11/2006 Douglas et al. ..... 250/292
2005/0263696 A1 * 12/2005 Wells ..... 250/292

FOREIGN PATENT DOCUMENTS

WO WO2004/013891 * 2/2004
WO WO2006/047889 * 5/2006

OTHER PUBLICATIONS

Amad, Ma'an H. et al., "High-Resolution Mass Spectrometry with a Multiple Pass Quadrupole Mass Analyzer," *Anal. Chem.*, vol. 70:4885-4889 (1998).

Amad, Ma'an H. et al., "Mass Resolution of 11,000 to 22,000 With a Multiple Pass Quadrupole Mass Analyzer," *J. Am. Soc. Mass Spectrom.*, vol. 11:407-415 (2000).

Ding, Chuanfan et al., "Quadrupole mass filters with octopole fields," *Rapid Communications in Mass Spectrometry*, vol. 17:2495-2502 (2003).

(Continued)

*Primary Examiner*—Jack I Berman
*Assistant Examiner*—Nicole Ippolito Rausch
(74) *Attorney, Agent, or Firm*—Lahive & Cockfield, LLP; Anthony A. Laurentano

(57) ABSTRACT

A mass spectrometer and a method of operating and building same is provided in which a hexapole component is deliberately added to a substantially quadrupole field. This can result in unwanted octopole and dipole fields also being added to the substantially quadrupole field. Modifications to the mass spectrometer as well as ways of operating the mass spectrometer are provided for dealing with the unwanted octopole and dipole fields.

58 Claims, 17 Drawing Sheets

OTHER PUBLICATIONS

Douglas, D.J. et al., "Collisional Focusing Effects in Radio Frequence Quadrupoles," *J. Am. Soc. Mass Spectrom*., vol. 3:398-408 (1992).

Douglas, D.J. et al., "Influence of the 6th and 10th spatial harmonics on the peak shape of a quadrupole mass filter with round rods," *Rapid Communications in Mass Spectrometry*, vol. 16:1425-1431 (2002).

Douglas, Donald J. et al., "Linear Ion Traps in Mass Spectrometry," *Mass Spectrometry Reviews*, vol. 24:1-29 (2005).

Douglas, D.J. et al., "Spatial harmonics of the field in a quadrupole mass filter with circular electrodes," *Zh. Tekh. Fiz*., vol. 69:96-101 (1999).

Hawson, Peter H., "The Mass Filter," Quadrupole Mass Spectrometry and its Applications, Elsevier Scientific Publishing Company, pp. 19-23 (1976).

Konenkov, N.V. et al., "Matrix Methods for the Calculation of Stability Diagrams in Quadrupole Mass Spectrometry," *J. Am. Soc. Mass Spectrom*., vol. 13:597-613 (2002).

Konenkov, N.V. et al., "Quadrupole mass filter operation with auxiliary quadrupolar excitation: theory and experiment," *International Journal of Mass Spectrometry*, vol. 208:17-27 (2001).

Konenkov, N.V. et al., "Upper Stability Island of the Quadrupole Mass Filter with Amplitude Modulation of the Applied Voltages," J. Am. Soc. Mass Spectrom., vol. 16:379-387 (2005).

McLachlam, N.W., "General Theory: Functions of Fractional Order: Solutions of Equations," Chapt. IV, pp. 57-103, "Hill's Equation," Chpt. VI, pp. 127-140, Theory and Application of Mathieu Functions (1947).

Moradian, Annie et al., "Experimental investigation of mass analysis using an island of stability with a quadrupole with 2.0% added octopole filed," Rapid Communications in Mass Spectrometry, vol. 21:3306-3310 (2007).

Moradian, Annie et al., "Mass Selective Axial Ion Ejection from Linear Quadrupoles with Added Octopole Fields," J. Am. Soc. Mass Spectrom., vol. 19(2):270-280 (2008).

Smythe, W.B., "Two-Dimensional Potential Distributions," Static and Dynamic Electricity, Chpt. IV, pp. 63-66 (1989).

Sudakov, Michael et al., "Linear quadrupoles with added octopole fields," Rapid Communications in Mass Spectrometry, vol. 17:2290-2294 (2003).

Völlkopf, Uwe et al., "ICP-MS Multielement Analysis at SUB-PPT Levels Applying New Instrumental Design Concepts," Plasma Source Mass Spectrometry—New Developments and Applications, pp. 63-72 (1999).

Wentzel, E.S., "Probability Theory (first steps)," Mir Publishers, pp. 78-87 (1989).

Zhao, Xian Zhen et al., "Quadrupole Excitation of Ions in Linear Quadrupole Ion Traps with Added Octopole Fields," J. Am. Soc. Mass Spectrom., vol. 19(4):510-519 (2008).

* cited by examiner

LINEAR QUADRUPOLES WITH ADDED HEXAPOLE FIELDS AND METHOD OF BUILDING AND OPERATING SAME

The application claims the benefit of U.S. Provisional Application Ser. No. 60/771,255, filed Feb. 7, 2006, the entire contents of which is hereby incorporated by reference.

FIELD

The invention relates in general to mass analysis, and more particularly relates to a method of mass analysis in a two-dimensional substantially quadrupole field with added higher multipole harmonics.

INTRODUCTION

The use of quadrupole electrode systems in mass spectrometers is known. For example, U.S. Pat. No. 2,939,952 (Paul et al.) describes a quadrupole electrode system in which four rods surround and extend parallel to a quadrupole axis. Opposite rods are coupled together and brought out to one of two common terminals. Most commonly, an electric potential $V(t)=+(U-V_{rf}\cos\Omega t)$ is then applied between one of these terminals and ground and an electric potential $V(t)=-(U-V_{rf}\cos\Omega t)$ is applied between the other terminal and ground. In these formulae, U is a DC voltage, pole to ground, $V_{rf}$ is a zero to peak AC voltage, pole to ground, $\Omega$ is the angular frequency of the AC, and t is time. The AC component will normally be in the radio frequency (RF) range, typically about 1 MHz.

In constructing a linear quadrupole, the field may be distorted so that it is not an ideal quadrupole field. For example round rods are often used to approximate the ideal hyperbolic shaped rods required to produce a perfect quadrupole field. The calculation of the potential in a quadrupole system with round rods can be performed by the method of equivalent charges—see, for example, Douglas et al., *Russian Journal of Technical Physics,* 1999, Vol. 69, 96-101 (hereinafter "reference [1]"). When presented as a series of harmonic amplitudes $A_0, A_1, A_2 \ldots A_N$, the potential in a linear quadrupole with a distorted field can be expressed as follows:

$$\phi(x, y, t) = V(t)\times\phi(x, y) = V(t)\sum_N A_N\phi_N(x, y) \tag{1}$$

Field harmonics $\phi_N$, which describe the variation of the potential in the X and Y directions, can be expressed as follows:

$$\phi_N(x, y) = \text{Real}\left[\left(\frac{x+iy}{r_0}\right)^N\right] \tag{2}$$

where Real[(f(x+iy)] is the real part of the complex function f(x+iy). For example:

$$A_0\phi_0(x, y) = A_0\text{Real}\left[\left(\frac{x+iy}{r_0}\right)^0\right] = A_0 \quad \text{Constant potential} \tag{3}$$

$$A_1\phi_1(x, y) = A_1\text{Real}\left[\left(\frac{x+iy}{r_0}\right)^1\right] = \frac{A_1 x}{r_0} \quad \text{Dipole potential} \tag{3.1}$$

-continued $$A_2\phi_2(x, y) = A_2\text{Real}\left[\left(\frac{x+iy}{r_0}\right)^2\right] = A_2\left(\frac{x^2-y^2}{r_0^2}\right) \quad \text{Quadruple} \tag{4}$$

$$A_3\phi_3(x, y) = A_3\text{Real}\left[\left(\frac{x+iy}{r_0}\right)^3\right] = A_3\left(\frac{x^3-3xy^2}{r_0^3}\right) \quad \text{Hexapole} \tag{5}$$

$$A_4\phi_4(x, y) = A_4\text{Real}\left[\left(\frac{x+iy}{r_0}\right)^4\right] = A_4\left(\frac{x^4-6x^2y^2+y^4}{r_0^4}\right) \quad \text{Octopole} \tag{6}$$

In these definitions, the X direction corresponds to the direction toward an electrode in which the potential $A_N$ increases to become more positive when V(t) is positive.

As shown above, $A_0\phi_0$ is the constant potential of the field (i.e. independent of X and Y), $A_1\phi_1$ is the dipole component of the field, $A_2\phi_2$ is the quadrupole component of the field, $A_3\phi_3$ is the hexapole component of the field, $A_4\phi_4$ is the octopole component of the field, and there are still higher order components of the field, although in a practical quadrupole the amplitudes of the higher order components are typically small compared to the amplitude of the quadrupole term.

In a quadrupole mass filter, ions are injected into the field along the axis of the quadrupole. In general, the field imparts complex trajectories to these ions, which trajectories can be described as either stable or unstable. For a trajectory to be stable, the amplitude of the ion motion in the planes normal to the axis of the quadrupole must remain less than the distance from the axis to the rods. Ions with stable trajectories will travel along the axis of the quadrupole electrode system and may be transmitted from the quadrupole to another processing stage or to a detection device. Ions with unstable trajectories will collide with a rod of the quadrupole electrode system and will not be transmitted.

The motion of a particular ion is controlled by the Mathieu parameters a and q of the mass analyzer. For positive ions, these parameters are related to the characteristics of the potential applied from terminals to ground as follows:

$$a_x = -a_y = a = \frac{8eU}{m_{ion}\Omega^2 r_0^2} \text{ and } q_x = -q_y = \frac{4eV_{rf}}{m_{ion}\Omega^2 r_0^2} \tag{7}$$

where e is the charge on an ion, $m_{ion}$ is the ion mass, $\Omega=2\pi f$ where f is the AC frequency, U is the DC voltage from pole to ground and $V_{rf}$ is the zero to peak AC voltage from each pole to ground. If the potentials are applied with different voltages between pole pairs and ground, then in equation (7) U and $V_{rf}$ are ½ of the DC potential and the zero to peak AC potential respectively between the rod pairs. Combinations of a and q which give stable ion motion in both the X and Y directions are usually shown on a stability diagram.

With operation as a mass filter, the pressure in the quadrupole is kept relatively low in order to prevent loss of ions by scattering by the background gas. Typically the pressure is less than $5\times10^{-4}$ torr and preferably less than $5\times10^{-5}$ torr. More generally quadrupole mass filters are usually operated in the pressure range $1\times10^{-6}$ torr to $5\times10^{-4}$ torr. Lower pressures can be used, but the reduction in scattering losses below $1\times10^{-6}$ torr are usually negligible.

As well, when linear quadrupoles are operated as a mass filter the DC and AC voltages (U and $V_{rf}$) are adjusted to place ions of one particular mass to charge ratio just within the tip of a stability region. Normally, ions are continuously introduced at the entrance end of the quadrupole and are continuously detected at the exit end. Ions are not normally confined within the quadrupole by stopping potentials at the entrance and exit. An exception to this is shown in the papers (see Ma'an H. Amad and R. S. Houk, "High Resolution Mass Spectrometry With a Multiple Pass Quadrupole Mass Analyzer", *Analytical Chemistry,* 1998, Vol. 70, 4885-4889 (hereinafter "reference [2]"), and Ma'an H. Amad and R. S. Houk, "Mass Resolution of 11,000 to 22,000 With a Multiple Pass Quadrupole Mass Analyzer", *Journal of the American Society for Mass Spectrometry,* 2000, Vol. 11, 407-415 (hereinafter "reference [3]"). These papers describe experiments where ions were reflected from electrodes at the entrance and exit of the quadrupole to give multiple passes through the quadrupole to improve the resolution. Nevertheless, the quadrupole was still operated at low pressure, although this pressure is not stated in these papers, and with the DC and AC voltages adjusted to place the ions of interest at the tip of the first stability region.

SUMMARY OF THE INVENTION

In accordance with an aspect of an embodiment of the invention, there is provided a mass spectrometer comprising (a) a quadrupole electrode system for connection to a voltage supply means for providing an at least partially-AC potential difference within the quadrupole electrode system, the quadrupole electrode system having (i) a quadrupole axis; (ii) a first pair of rods; (iii) a second pair of rods, wherein each rod in the first pair of rods and the second pair of rods is spaced from and extends alongside the quadrupole axis and is substantially cylindrical; (iii) a voltage connection means for connecting at least one pair of the first pair of rods and the second pair of rods to the voltage supply means to provide the at least partially-AC potential difference between the first pair of rods and the second pair of rods such that in use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$ and a hexapole harmonic with amplitude $A_3$ wherein the magnitude of $A_3$ is greater than 0.1% of the magnitude of $A_2$; and, (b) an ion source for injecting ions substantially centered along a field centre of the two-dimensional substantially quadrupole field, wherein the field centre is spaced from the quadrupole axis such that a dipole potential of the two-dimensional substantially quadrupole field is lower along the field centre than along the quadrupole axis.

In accordance with a second aspect of an embodiment of the invention, there is provided a method of processing ions in a quadrupole mass filter having a quadrupole axis and a rod set having a plurality of rods, wherein each rod in the plurality of rods is equidistant from the quadrupole axis and is substantially cylindrical. The method comprises a) establishing and maintaining a two-dimensional substantially quadrupole field for processing ions within a selected range of mass to charge ratios, the field having a quadrupole harmonic with amplitude $A_2$ and a hexapole harmonic with amplitude $A_3$, wherein $A_3$ is greater than 0.1% of $A_2$; b) determining a field centre of the two-dimensional substantially quadrupole field wherein the field centre is spaced from the quadrupole axis such that a dipole potential of the two-dimensional substantially quadrupole field is lower along the field centre than along the quadrupole axis; and, c) introducing ions to the field such that the ions are substantially centered around the field centre, wherein the field imparts stable trajectories to ions within the selected range of mass to charge ratios to retain such ions in the mass filter for transmission through the mass filter, and imparts unstable trajectories to ions outside of the selected range of mass to charge ratios to filter out such ions.

In accordance with a third aspect of an embodiment of the invention, there is provided a quadrupole electrode system for connection to a voltage supply means for providing an at least partially-AC potential difference within the quadrupole electrode system. The quadrupole electrode system comprises a) a quadrupole axis; b) a first pair of rods, wherein each rod in the first pair of rods is spaced from and extends alongside the quadrupole axis; c) a second pair of rods, wherein each rod in the second pair of rods is spaced from and extends alongside the quadrupole axis, wherein the first pair of rods and the second pair of rods are substantially cylindrical; and d) a voltage connection means for connecting at least one pair of the first pair of rods and the second pair of rods to the voltage supply means to provide the at least partially-AC potential difference between the first pair of rods and the second pair of rods such that in use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$, a hexapole harmonic with amplitude $A_3$, and an octopole harmonic with amplitude $A_4$ wherein the magnitude of $A_3$ is greater than 0.1% of the magnitude of $A_2$ and the magnitude of $A_4$ is less than 0.1% of the magnitude of $A_2$.

In accordance with a fourth aspect of an embodiment of the invention, there is provided a method of manufacturing a quadrupole electrode system for connection to a voltage supply means for providing an at least partially-AC potential difference within the quadrupole electrode system to generate a two-dimensional substantially quadrupole field for manipulating ions, the two-dimensional substantially quadrupole field having a quadrupole harmonic with amplitude $A_2$. The method comprises the steps of: a) determining a hexapole harmonic with amplitude $A_3$ to be included in the field, wherein the magnitude of $A_3$ is greater than 0.1% of the magnitude of $A_2$; and b) installing a first pair of rods and a second pair of rods about a central axis such that the first pair of rods and the second pair of rods are spaced from and extend alongside the central axis. The first pair of rods and the second pair of rods are substantially cylindrical. Step b) comprises i) locating the second pair of rods closer to one rod in the first pair of rods than to the other rod in the first pair of rods to add the hexapole harmonic; and ii) making the first pair of rods larger than the second pair of rods to reduce an octopole harmonic of the field added by step b) i) such that an amplitude $A_4$ of the octopole harmonic is less than 0.1% of $A_2$.

In accordance with a fifth aspect of an embodiment of the invention, there is provided a method of processing ions in a quadrupole mass filter having a quadrupole axis and a rod set having a plurality of rods, wherein each rod in the plurality of rods is equidistant from the quadrupole axis and is substantially cylindrical. The method comprises a) establishing and maintaining a two-dimensional substantially quadrupole field for processing ions within a selected range of mass to charge ratios, the two-dimensional substantially quadrupole field having a quadrupole harmonic with amplitude $A_2$, a hexapole harmonic with amplitude $A_3$, and an octopole harmonic with amplitude $A_4$ wherein the magnitude of $A_3$ is greater than 0.1% of the magnitude of $A_2$ and the magnitude of $A_4$ is less than 0.1% of the magnitude of $A_2$; and, b)

introducing ions to the field, wherein the field imparts stable trajectories to ions within the selected range of mass to charge ratios to retain such ions in the mass filter for transmission through the mass filter, and imparts unstable trajectories to ions outside of the selected range of mass to charge ratios to filter out such ions.

These and other features of the applicants teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DESCRIPTION OF VARIOUS EMBODIMENTS

Figure 1:
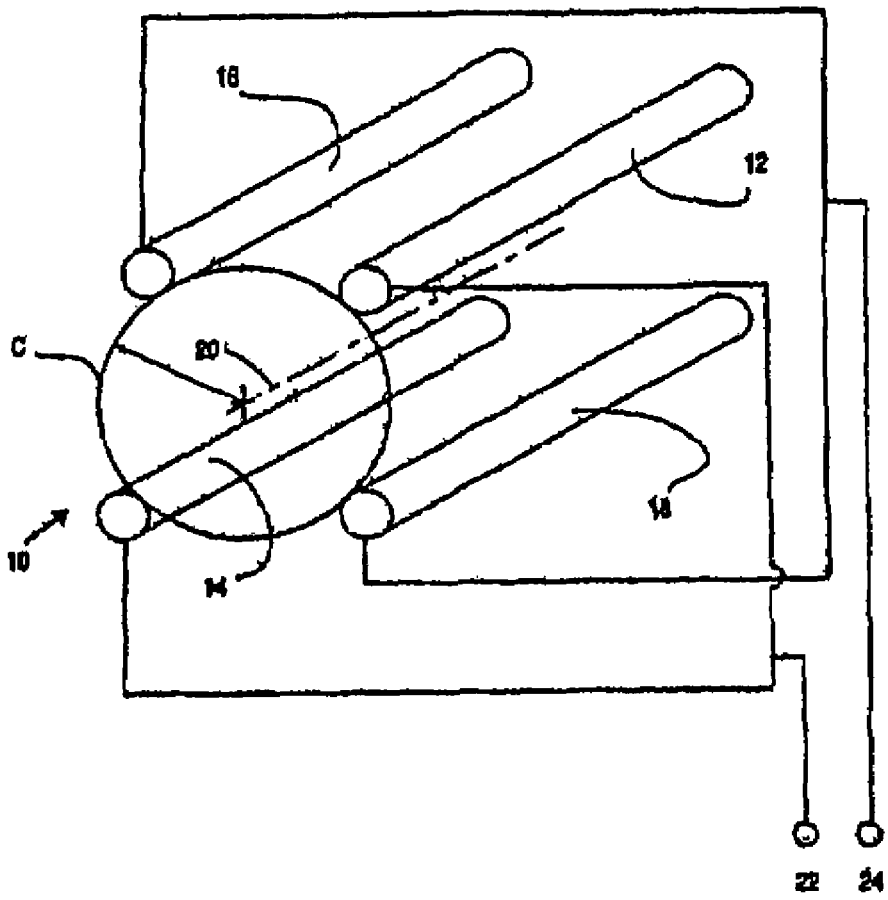
FIG. 1, in a schematic perspective view, illustrates a set of quadrupole rods.

Referring to FIG. 1, there is illustrated a quadrupole rod set 10 according to the prior art. Quadrupole rod set 10 comprises rods 12, 14, 16 and 18. Rods 12, 14, 16 and 18 are arranged symmetrically around axis 20 such that the rods have an inscribed circle C having a radius $r_0$. The cross sections of rods 12, 14, 16 and 18 are ideally hyperbolic and of infinite extent to produce an ideal quadrupole field, although rods of circular cross-section are commonly used. As is conventional, opposite rods 12 and 14 are coupled together and brought out to a terminal 22 and opposite rods 16 and 18 are coupled together and brought out to a terminal 24. An electrical potential $V(t)=+(U-V_{rf}\cos\Omega t)$ is applied between terminal 22 and ground and an electrical potential $V(t)=-(U-V_{rf}\cos\Omega t)$ is applied between terminal 24 and ground. Alternatively, of course, terminals 22 and 24 may be connected to a common DC voltage, as is well known in the art. The power supplies for the DC voltage can be arranged so that terminals 22 and 24 have a common offset voltage. When operating conventionally as a mass filter, as described below, for mass resolution, the potential applied has both a DC and AC component. For operation as a mass filter or an ion trap, the potential applied is at least partially-AC. That is, an AC potential will always be applied, while a DC potential will often, but not always, be applied. As is known, in some cases just an AC voltage is applied. The rod sets to which the positive DC potential is coupled may be referred to as the positive rods and those to which the negative DC potential is coupled may be referred to as the negative rods.

Figure 2:
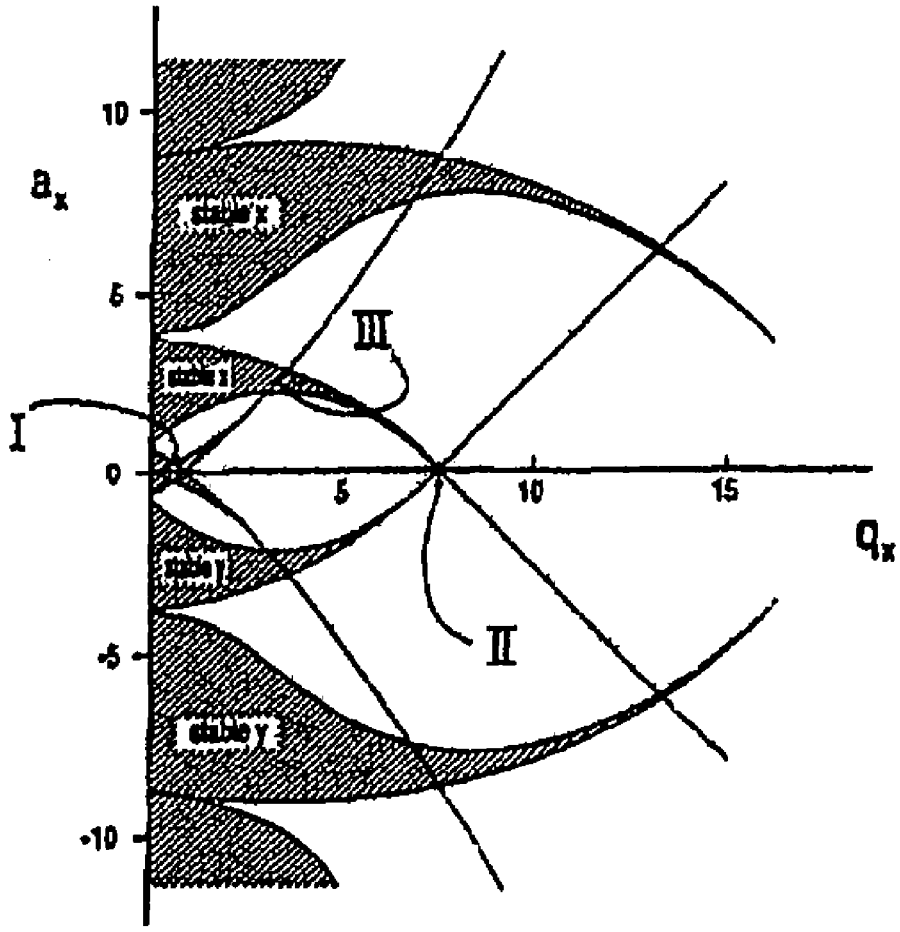
FIG. 2, in a stability diagram, illustrates combinations of a and q that provide stable ion motion in both the X and Y directions.

As described above, the motion of a particular ion is controlled by the Mathieu parameters a and q of the mass analyzer. These parameters are related to the characteristics of the potential applied from terminals 22 and 24 to ground as follows:

$$a_x = -a_y = a = \frac{8eU}{m_{ion}\Omega^2 r_0^2} \text{ and } q_x = -q_y = \frac{4eV_{rf}}{m_{ion}\Omega^2 r_0^2} \tag{7}$$

where e is the charge on an ion, $m_{ion}$ is the ion mass, Q=2λf where f is the AC frequency, U is the DC voltage from a pole to ground and $V_{rf}$ is the zero to peak AC voltage from each pole to ground. Combinations of a and q which give stable ion motion in both the X and Y directions are shown on the stability diagram of FIG. 2. The notation of FIG. 2 for the regions of stability is taken from P. H. Dawson ed., "Quadrupole Mass Spectrometry and Its Applications", Elsevier, Amsterdam, 1976, (hereinafter "reference [4]") at pages 19-23. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). Selection of the desired stability regions, and selected tips or operating points in each region, will depend on the intended application.

Ion motion in a direction u in a quadrupole field can be described by the equation $$u(\xi) = A\sum_{n=-\infty}^{\infty} C_{2n}\cos[(2n+\beta)\xi] + B\sum_{n=-\infty}^{\infty} C_{2n}\sin[(2n+\beta)\xi] \tag{8}$$

where $$\xi = \frac{\Omega t}{2}$$

and t is time, $C_{2n}$ depend on the values of a and q, and A and B depend on the ion initial position and velocity (see, for example, R. E. March and R. J. Hughes, "Quadrupole Storage Mass Spectrometry", John Wiley and Sons, Toronto, 1989, page 41 (hereinafter "reference [5]"). The value of β determines the frequencies of ion oscillation, and β is a function of the a and q values (see page 70 of reference [4]). From equation 8, the angular frequencies of ion motion in the X ($\omega_x$) and Y ($\omega_y$) directions in a two-dimensional quadrupole field are given by $$\omega_x = (2n+\beta_x)\frac{\Omega}{2} \tag{9}$$

$$\omega_y = (2n+\beta_y)\frac{\Omega}{2} \tag{10}$$

where n=0, ±1, ±2, ±3 . . . , $0 \leqq \beta_x \leqq 1$, $0 \leqq \beta_y \leqq 1$, in the first stability region and $\beta_x$ and $\beta_y$ are determined by the Mathieu parameters a and q for motion in the X and Y directions respectively (equation 7).

As described in U.S. Pat. No. 6,897,438 (Soudakov et al.); U.S. Pat. No. 7,141,789 (Douglas et al.); and U.S. Pat. No. 7,045,797 (Sudakov et al.), two-dimensional quadrupole fields used in mass spectrometers can be improved at least for some applications by adding higher order harmonics order such as hexapole or octopole harmonics to the field. As described in these references, the hexapole and octopole components added to these fields will typically substantially exceed any octopole or hexapole components resulting from manufacturing or construction errors, which are typically well under 0.1%. For example, a hexapole component $A_3$ can typically be in the range of 1 to 6% of $A_2$, and may be as high as 20% of $A_2$ or even higher. Octopole components $A_4$ of similar magnitude may also be added.

As described in U.S. Pat. No. 7,141,789, the contents of which are hereby incorporated by reference, a hexapole field can be provided to a two-dimensional substantially quadrupole field by providing suitably shaped electrodes or by constructing a quadrupole system in which the two Y rods have been rotated in opposite directions to be closer to one of the X rods than to the other of the X rods. Similarly, as described in U.S. Pat. No. 6,897,438, the contents of which are hereby incorporated by reference, an octopole field can be provided by suitably shaped electrodes, or by constructing the quadrupole system to have a 90° asymmetry, by, for example, making the X rods larger in diameter than the Y rods.

It is also possible, as described in U.S. Pat. No. 7,141,789 to simultaneously add both hexapole and octopole components by both rotating one pair of rods towards the other pair of rods, while simultaneously changing the diameter of one pair of rods relative to the other pair of rods. This can be done in two ways. The larger rods can be rotated toward one of the smaller rods, or the smaller rods can be rotated toward one of the larger rods.

Figure 3:
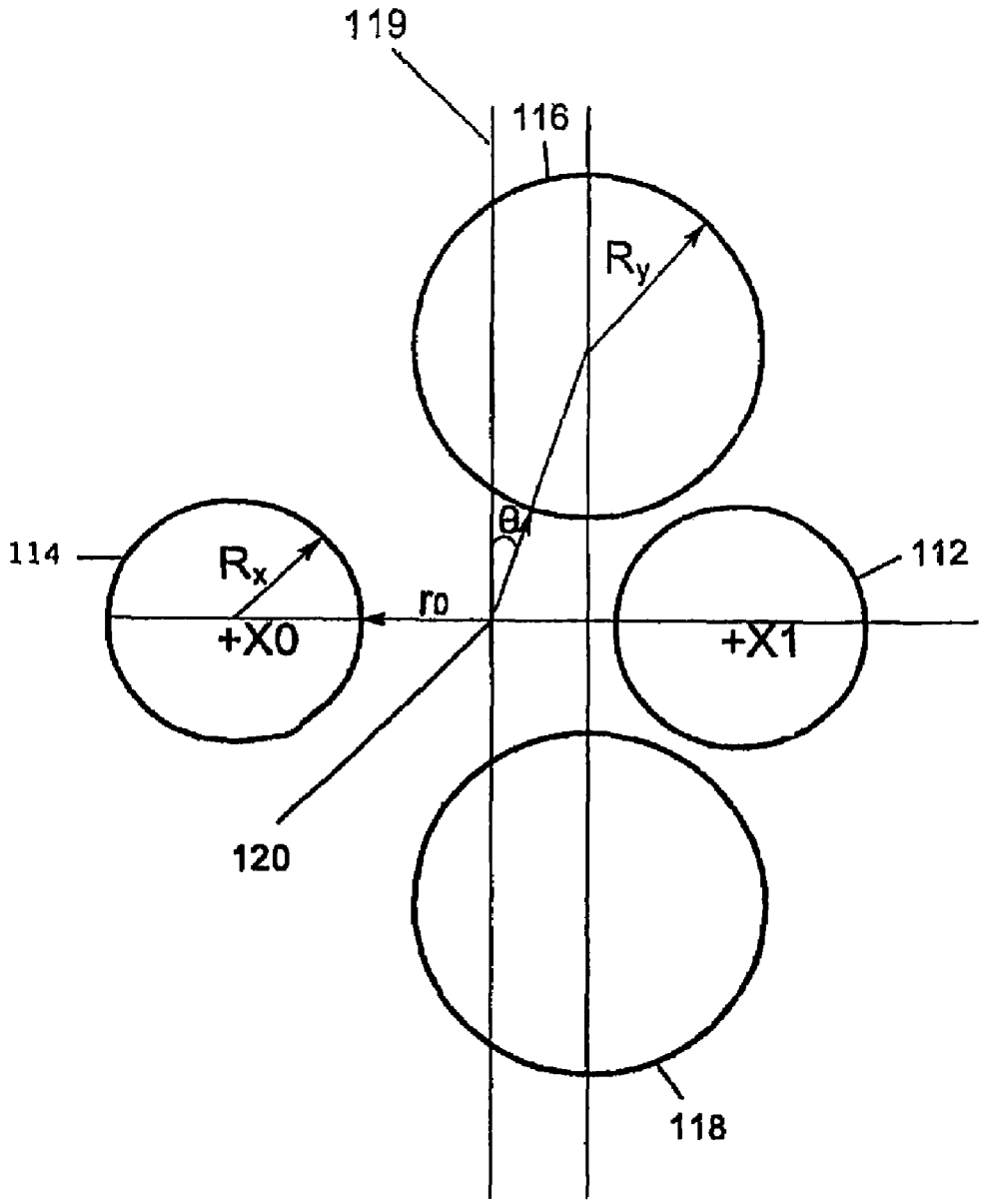
FIG. 3, in a schematic perspective view, illustrates a set of quadrupole rods in which the Y rods have undergone a rotation through an angle θ toward one of the X rods, and in which the diameter of the Y rods has been increased relative to the diameter of the X rods to add a desired octopole component to the field.

Referring to FIG. 3, there is illustrated in a sectional view, a set of quadrupole rods including Y rods that have undergone such rotation through an angle θ. The set of quadrupole rods includes X rods 112 and 114, Y rods 116 and 118, and quadrupole axis 120. The Y rods have radius $R_y$ and the X rods have radius $R_x$. All rods are a distance $r_0$ from the central axis 120 and $R_x=r_0$. The radius of the Y rods is greater than the radius of the X rods ($R_y>R_x$). When the Y rods are rotated toward the X rods, a dipole potential of amplitude $A_1$ is created. This can be removed by increasing the magnitude of the voltage on X rod 112 relative to the magnitude of the voltage applied to the X rod 114 and Y rods 116 and 118.

When round rods are used to add a hexapole or octopole harmonic to a two-dimensional substantially quadrupole field, the resolution, transmission and peak shape obtained in mass analysis may be degraded. Nonetheless, the addition of hexapole and octopole components to the field, and possibly other higher order multipoles, remains desirable for enhancing fragmentation and otherwise increasing MS/MS efficiency, as well as peak shape and for ion excitation for MS/MS or for ion ejection when the rod set is used as an ion trap, as described below and in U.S. Pat. Nos. 6,897,438; 7,141,789; and, 7,045,797. However, in some instruments, it is important that a linear quadrupole trap that is used for MS/MS also be capable of being operated as a mass filter. For rods sets with added hexapole fields, performance as a mass filter can be improved by modifying the rods to substantially remove at least some of the unwanted higher order components of the fields, and by injecting the ions at the field center, rather than along the quadrupole axis, of the quadrupole rod set.

MS/MS Efficiency of a Linear Quadrupole Trap with Added Higher Multipoles

Several studies have shown that the MS/MS efficiency (or fragmentation efficiency) of a linear quadrupole trap is improved by adding higher multipoles to the potential. Collings, B. A.; Stoft, W. R.; Londry, F. A. Resonant excitation in a low pressure linear ion trap. *J. Am. Soc. Mass Spectrom.* 2003, 14, 622-634 (hereinafter "reference [6]") found surprisingly high MS/MS efficiency in a linear quadrupole operated at a pressure of $3.5\times10^{-5}$ torr. This was attributed to the multipoles added to the potential by constructing the quadrupole with round rods. In a later study Collings showed that the addition of a DC octopole to the potential with auxiliary electrodes could also increase the MS/MS efficiency (see Collings, B. A. Increased Fragmentation Efficiency of Ions in a Low Pressure Linear Ion Trap with an Added DC Octopole Field, *J. Am. Soc. Mass Spectrom.* 2005, 16, 1342-1352 (hereinafter "reference [7]")). An octopole field can be added to a linear quadrupole by constructing the quadrupole with one rod pair different in diameter from the other rod pair, or by using different spacings from the axis of equal diameter rod pairs (see Sudakov, M.; Douglas, D. J. Linear quadrupoles with added octopole fields. *Rapid Commun. Mass Spectrom.* 2003, 17, 2290-2294 (hereinafter "reference [8]")). Michaud et al. showed that a linear quadrupole with an added 4% octopole field can have substantially higher MS/MS efficiency than a conventional quadrupole rod set constructed from round rods, particularly at trap pressures of $10^{-4}$ torr or less of $N_2$ (see Michaud, A. L.; Frank, A. J.; Ding, C.; Zhao, X; Douglas, D. J. Ion Excitation in a Linear Quadrupole Ion Trap with an Added Octopole Field, *J. Am. Soc. Mass Spectrom.* 2005, 16, 835-849 (hereinafter "reference [9]")).

Frequency shifts can also be induced by the addition of a hexapole to a quadrupole potential, and addition of a hexapole should also increase MS/MS efficiency. The potential of a linear quadrupole with an added hexapole and no other multipoles is given by $$V(x, y, t) = \left[A_2\left(\frac{x^2 - y^2}{r_0^2}\right) + A_3\left(\frac{x^3 - 3xy^2}{r_0^3}\right)\right]\varphi(t) \tag{11}$$

where $A_2$ and $A_3$ are the dimensionless amplitudes of the quadrupole and hexapole fields, $A_2 \approx 1$, $r_0/\sqrt{A_2}$ is the distance from the centre of the quadrupole to a y electrode when x=0, and $\pm\phi(t)$ is the voltage applied the electrodes. We describe the frequency shifts expected from the addition of a hexapole field within the effective potential model, and methods to construct a linear quadrupole with added hexapole field with exact electrode geometry. We show a quadrupole with added hexapole can be constructed with round rods by rotating two rods (say the Y rods) towards an X rod. In some instruments it is desirable to have a linear quadrupole which can be operated as a trap with high MS/MS efficiency at pressures of ca. $10^{-5}$ torr but the same quadrupole should preferably be capable of mass analysis in rf/dc mode (see Hager, J. W. A New Linear Ion Trap Mass Spectrometer, Rapid Commun. Mass Spectrom. 2002, 16, 512-526. (hereinafter "reference [10]"). It has been found that linear quadrupoles with added octopole fields can perform mass analysis provided the DC potential is applied to the rods with the correct polarity (see Ding, C.; Konenkov, N. V.; Douglas, D. J. Quadrupole mass filters with octopole fields. *Rapid Commun. Mass Spectrom.* 2003, 17, 2495-2502 (hereinafter "reference [11]")). Thus we also use computer simulations to investigate mass analysis with quadrupoles with added hexapole fields. We find that a quadrupole that has potential given by eq 11 can give good peak shape and transmission in mass analysis provided the DC is applied with the correct polarity and value, but that when a rod set is constructed with round rods, other multipoles in the potential degrade the peak shape, resolution and transmission. The largest of these after the quadrupole and hexapole are a dipole and octopole term. With round rod sets the peak shape can be improved by using different diameters for the X and Y rod pairs to minimize the octopole term in the potential and by injecting ions at the field center where the dipole term is zero. Calculations of the boundaries of the stability diagram for this case show the boundaries move out, relative to those of a pure quadrupole field.

Multipole Calculations

In general a two dimensional time-dependent electric potential can be expanded in multipoles as $$V(x, y, t) = \varphi(t)\sum_{N=0}^{\infty} A_N \phi_N(x, y) \tag{12}$$

where $A_N$ is the dimensionless amplitude of the multipole $\phi_N(x,y)$ and $\phi(t)$ is a time dependent voltage applied to the electrodes (see Smythe, W. R. *Static and Dynamic Electricity*, McGraw-Hill Book Company, New York, 1939 (hereinafter "reference [12]")). For a quadrupole mass filter, $\phi(t)=U-V_{rf}\cos\Omega t$. Without loss of generality, for $N \geqq 1$, $\phi_N(x,y)$ can be calculated from $$\phi_N(x, y) = \mathrm{Re}\left[\frac{x + iy}{r_0}\right]^N \tag{13}$$

where $\mathrm{Re}[(f(\zeta)]$ means the real part of the complex function $f(\zeta)$, $\zeta = x+iy$, and $i^2=-1$. For rod sets with round rods, amplitudes of multipoles given by eq 12 were calculated with the method of effective charges (see Douglas, D. J.; Glebova, T.; Konenkov, N.; Sudakov, M. Y. Spatial Harmonics of the Field in a Quadrupole Mass Filter with Circular Electrodes, *Technical Physics,* 1999, 44, 1215-1219 (hereinafter "reference [13]")).

Ion Source Model

Collisional cooling of ions in an RF quadrupole (or other multipole) has become a common method of coupling atmospheric pressure ion sources such as ESI to mass analyzers (see (a) Douglas, D. J.; French, J. B. Collisional Focusing Effects in Radio Frequency Quadrupoles, *J. Am. Soc. Mass Spectrom.* 1992, 3, 398-408. (b) Douglas, D. J.; Frank, A. J.; Mao, D. Linear Ion Traps in Mass Spectrometry, *Mass Spec. Rev.* 2005, 24, 1-29 (hereinafter "reference [14a] and [14b]" respectively)). Collisions with background gas can cool ions and concentrate ions near the quadrupole axis. We use an approximate model of a thermalized distribution of ions as the source for calculations of peak shapes and stability diagrams. At the input of the quadrupole, the ion spatial distribution is approximated as a Gaussian distribution with the probability density function f(x,y)

$$f(x, y) = \frac{1}{2\pi\sigma_x^2} e^{-\left(\frac{x^2+y^2}{2\sigma_x^2}\right)} \tag{14}$$

where $\sigma_x$ determines the spatial spread.

Modeling initial ion coordinates x and y with a random distribution given by eq 14 is based on the central limit theorem (see Venttsel E. S. Theory of Probability. Moscow. High School. 2002. p. 303 (hereinafter "reference [15]")) for uniformly distributed values $x_i$ and $y_i$ on the interval $[-r_0, r_0]$ for dimensionless variables $\tilde{x}=x/r_0$ and $\tilde{y}=y/r_0$ on the interval [−1, 1]. The distribution of eq 14 can be generated from $$\tilde{x} = \sqrt{\frac{3}{m}}\,\sigma_x \sum_{i=1}^{m} x_i;\ \tilde{y} = \sqrt{\frac{3}{m}}\,\sigma_y \sum_{i=1}^{m} y_i \tag{15}$$

where m is the number of random numbers $x_i$ and $y_i$ generated by a computer. In our calculations m=100. The standard deviation $\sigma_x$ determines the radial size of the ion beam.

The initial ion velocities in the x and y directions $v_x$ and $v_y$ are taken from a thermal distribution given by $$g(v_x, v_y) = \frac{1}{2\pi\sigma_v^2} e^{-\left(\frac{m(v_x^2+v_y^2)}{2kT}\right)} \tag{16}$$

where $$\sigma_v = \sqrt{\frac{2kT}{m}}$$

is the ion velocity dispersion, k is Boltzmann's constant, T is the ion temperature, m is the ion mass. Transverse velocities in the interval $[-3\sigma_v, 3\sigma_v]$ were used for every initial position. The dimensionless variables $$\xi = \frac{\Omega t}{2}$$

and $$u = \frac{x}{r_0}$$

are used in the ion motion equations. Then $$\frac{du}{d\xi} = \frac{dx}{dt}\frac{1}{\pi r_0 f} = \frac{v}{\pi r_0 f}$$

and $$f = \frac{\Omega}{2\pi}.$$

The dimensionless velocity dispersion $\sigma_u$ is $$\sigma_u = \frac{\sigma_v}{\pi r_0 f} = \frac{\sqrt{\frac{2kT}{m}}}{\pi r_0 f} = \frac{1}{\pi r_0 f}\sqrt{\frac{2RT}{M}} \tag{17}$$

where R is the gas constant, and M is the ion mass in Daltons. For typical conditions: M=390 Da, $r_0=5\times10^{-3}$m, f=$1.0\times10^6$ Hz, and T=300K, eq 17 gives $\sigma_u=\sigma_v/\pi r_0 f=0.0072$. The ion velocity dispersion $\sigma_v$ decreases with M as $M^{-1/2}$. This helps to improve the transmission of a quadrupole mass filter at higher mass.

Figure 4:
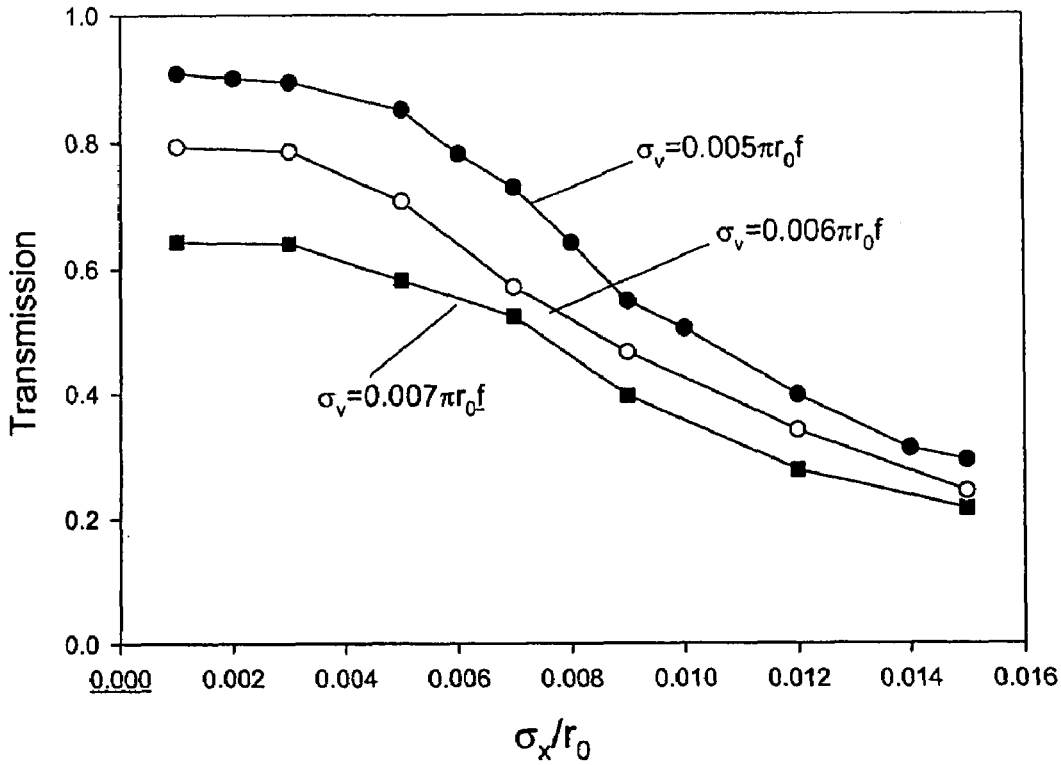
FIG. 4, in a graph, illustrates transmission vs. $\sigma_x/r_0$ for different values of transverse ion velocity dispersion $\sigma_v$ with mass 390, 300K, resolution q/Δq of scan line of R=390, λ=0.1676, and 150 rf cycles in the field.
Figure 5:
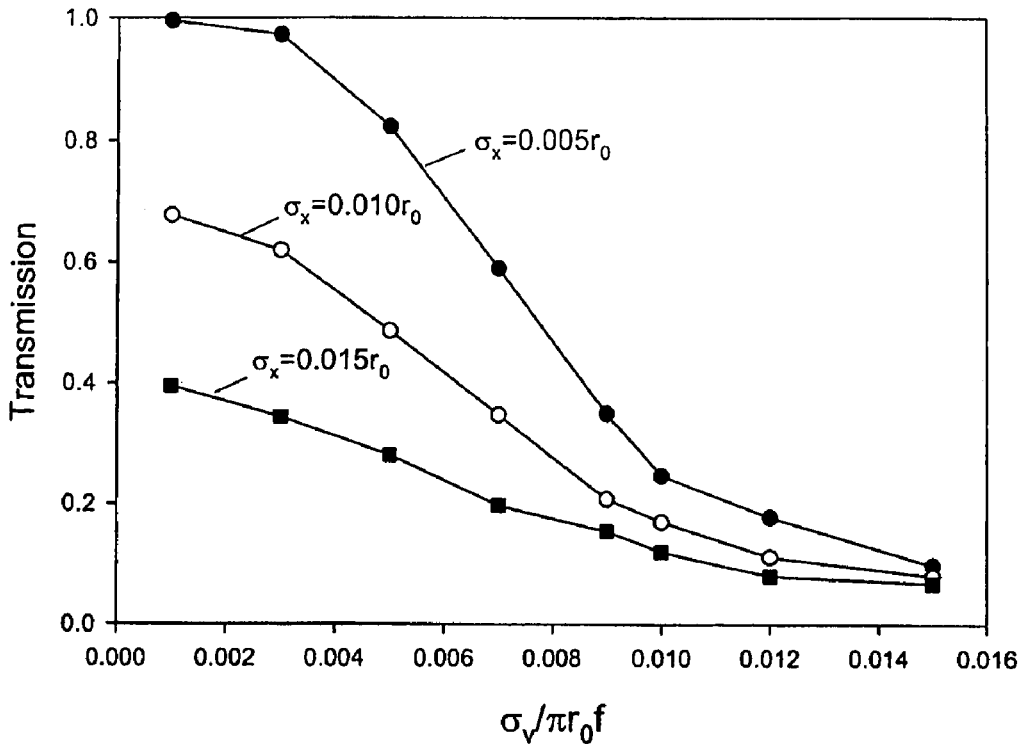
FIG. 5, in a graph, illustrates transmission vs. $\sigma_v/\pi r_0 f$ for three different spatial dispersions $\sigma_x$ for the conditions of FIG. 4.

The ion source model is characterized by the two parameters $\sigma_x$ and $\sigma_v$. The influence of the radial size of the ion beam on transmission for different values $\sigma_v$ is shown in FIG. 4. These data were calculated for a resolution q/Δq of the scan line of R=390, λ=0.1676 (λ is defined below), ion temperature T=300K, a separation time of n=150 rf cycles, a pure quadrupole field and no fringing fields. With ions concentrated near the axis with $\sigma_x<0.006r_0$ the transmission does not depend strongly on $\sigma_x$ for given values $\sigma_v$. For the same conditions the transmission for different values of $\sigma_x$ are shown in FIG. 5. High transmission, near 100% at m/z=390, is possible because of the small ion beam emittance with $\sigma_x=0.005r_0$ and $\sigma_v=0.003\pi r_0 f$.

Peak Shape and Stability Region Calculations

Ion motion in quadrupole mass filters is described by the two Mathieu parameters a and q given by $$a = \frac{8eU}{mr_0^2\Omega} \text{ and } q = \frac{4eV_{rf}}{mr_0^2\Omega^2} \tag{18}$$

where e is the charge on an ion, U is the DC applied from an electrode to ground and $v_{rf}$ is the zero to peak RF voltage applied from an electrode to ground. For given applied voltages U and $V_{rf}$, ions of different mass to charge ratios lie on a scan line of slope $$a/q = 2\lambda = \frac{2U}{V_{rf}} \tag{19}$$

The presence of higher order spatial harmonics in addition to the quadrupole field leads to changes in the stability diagram (reference [11]). The detailed mathematical theory of the calculation of the stability boundaries for Mathieu and Hill equations is given in McLachlan, N. W. *Theory and Applications of Mathieu Functions*, Oxford University Press, UK, 1947 (hereinafter "reference [16]") and for mass spectrometry applications is reviewed in Konenkov, N. V.; Sudakov, M. Yu.; Douglas D. J. Matrix Methods for the Calculation of Stability Diagrams in Quadrupole Mass Spectrometry. *J. Am. Soc. Mass Spectrom.* 2002, 13, 597-613. (hereinafter "reference [17]"). However these methods cannot be used when the x and y motions are coupled by higher spatial harmonics. Instead, the stability boundaries can be found by direct simulations of the ion motion. With higher multipoles in the potential, ion motion is determined by (Douglas, D. J.; Konenkov, N. V. (Influence of the $6^{th}$ and $10^{th}$ Spatial Harmonics on the Peak Shape of a Quadrupole Mass Filter with Round Rods). *Rapid Commun. Mass Spectrom.* 2002, 16, 1425-1431 (hereinafter "reference [18]");

$$\frac{d^2x}{d\xi^2} + [\alpha + 2q\cos 2(\xi - \xi_0)]x = -\frac{1}{2}[\alpha + 2q\cos 2(\xi - \xi_0)]\sum_{N=3}^{10}\frac{A_N\frac{\partial\phi_N}{\partial x}}{A_2^{N/2}r_0^{N-2}} \tag{20}$$

$$\frac{d^2y}{d\xi^2} - [\alpha + 2q\cos 2(\xi - \xi_0)]y = -\frac{1}{2}[\alpha + 2q\cos 2(\xi - \xi_0)]\sum_{N=3}^{10}\frac{A_N\frac{\partial\phi_N}{\partial y}}{A_2^{N/2}r_0^{N-2}} \tag{21}$$

Equations 21 and 22 were solved by the Runge-Kutta-Nystrom-Dormand-Prince (RK-N-DP) method [18] and multipoles up to N=10 were included. With the ion source model described above, $\mathcal{N}$ ion trajectories were calculated for fixed rf phases $\xi_0=0, \pi/20, 2*\pi/20, 3*\pi/20, \ldots, 19*\sigma/20$. If a given ion trajectory is not stable (x or $y \geqq r_0$) in the time interval $0<\xi<n\pi$, where n is the number of rf cycles which the ions spend in the quadrupole field, the program starts calculating a new trajectory. From the number of transmitted ions, $\mathcal{N}_t$, at a given point (a,q) the transmission is $T=\mathcal{N}_t/\mathcal{N}$. For both peak shape and stability boundary calculations, the number of ion trajectories, $\mathcal{N}$, was 6000 or more at each point of a transmission curve. For the calculation of peak shapes, the values of a and q were systematically changed on a scan line with a fixed ratio λ. For the calculation of stability boundaries, a was systematically varied to produce a curve of transmission vs. q. The true boundaries correspond to $n \rightarrow \infty$. For a practical calculation we choose n=150 and the 1% level of transmission.

Frequency Shifts with an Added Hexapole Field

The frequency shifts that occur when a hexapole field is added to a linear quadrupole field can be calculated within the effective potential approximation. For an ion of mass m and charge e, in an inhomogeneous electric field $\vec{E}$ oscillating at angular frequency Ω, the effective electric potential $V_{eff}$ (see Gerlich, D. 1992. *Advances in Chemical Physics* LXXXII. Inhomogeneous RF fields: a versatile tool for the study of processes with slow ions. New York: John Wiley and Sons. p 1-176 (hereinafter "reference [20]")) is given by $$V_{eff} = \frac{e|\vec{E}|^2}{4m\Omega^2} \tag{22}$$

where $$|\vec{E}|^2=(E_x^2+E_y^2+E_z^2) \tag{23}$$

For the potential of eq 11 when $\phi(t)=V_{rf}\cos \Omega t$ eq 22 and 23 lead to $$V_{eff}(x, y) = \frac{qA_2^2x^2}{4r_0^2}V_{rf} + \frac{3qA_2A_3x^3}{4r_0^3}V_{rf} + \frac{9qA_3^2x^4}{16r_0^4}V_{rf} + \frac{qA_2^2y^2}{4r_0^2}V_{rf} + \frac{9qA_3^2y^4}{16r_0^4}V_{rf} + \ldots \tag{24}$$

Higher order terms in $x^m y^n$ have not been included because we are interested in the x motion when y=0, and the y motion when x=0. To first order in $A_3$, the hexapole does not cause a shift in the frequency of oscillation because, while the force increases more rapidly than that of a harmonic oscillator in the positive x direction, it increases less rapidly in the negative x direction. However in second order it does cause a frequency shift. Motion in the x direction in the effective potential of eq 24 is determined by $$m\ddot{x} = F_x = -e\frac{\partial V_{eff}(x, y)}{\partial x} \tag{25}$$

which leads to $$\ddot{x} + \omega_0^2 x = -\frac{9eqA_2A_3}{4mr_0^3}V_{rf}x^2 - \frac{36eqA_3^2}{16mr_0^4}V_{rf}x^3 \tag{26}$$

with $$\omega_0^2 = \frac{eqA_2^2V_{rf}2}{4mr_0^2} \tag{27}$$

or $$\omega_0 = \frac{qA_2}{\sqrt{8}}\Omega \tag{28}$$

The left side of eq 26 describes the secular motion of an ion trapped in a quadrupole field at low q values and the right side describes the modifications caused by the hexapole fields. Equation 26 is of the form $$\ddot{x}+\omega_0^2x=-\alpha x^2-\beta x^3 \tag{29}$$

with $$\alpha = \frac{9}{2}\left(\frac{A_3}{A_2}\right)\frac{\omega_0^2}{r_0} \text{ and } \beta = \frac{9A_3^2}{2A_2^2}\frac{\omega_0^2}{r_0^2} \tag{30}$$

The solution of eq 29 has been described by Landau and Lifshitz (see Landau, L. D.; Lifshitz, E. M. *Mechanics* 3rd Ed. New York: Pergamon Press, 1960, pp 74-93 (hereinafter "reference [21]")). The terms on the right of eq 29 cause a shift in the frequency of ion oscillation given by $$\Delta\omega = \left(\frac{3\beta}{8\omega_0} - \frac{5\alpha^2}{12\omega_0^3}\right)b^2 \tag{31}$$

where b is the amplitude of oscillation. Thus the term in α in eq 26 causes a shift down in frequency of $$\Delta\omega_\alpha = -\frac{5}{12}\frac{81A_3^2}{4A_2^2}\frac{b^2}{r_0^2}\omega_0 \tag{32}$$

This shift was calculated by Sevugarajan and Menon (see Sevugarajan, S.; Menon, A. G. Field imperfection induced axial secular frequency shifts in nonlinear ion traps. *Int. J. Mass Spectrom.* 1999, 189, 53-61 (hereinafter "reference [22]")) for the z motion in a 3D trap with an added hexapole field. The term in β in eq 26 causes a shift up of $$\Delta\omega_\beta = +\frac{3\beta}{8\omega_0}b^2 = +\frac{27A_3^2}{16A_2^2}\frac{b^2}{r_0^2}\omega_0 \tag{33}$$

For example, if $A_3=0.02$ and $b=r_0$, $\Delta\omega_\alpha=-3.38\times10^{-3}\ \omega_0$ and $\Delta\omega_\beta=+6.75\times10^{-4}\ \omega_0$ The combined frequency shift for the x motion ($\Delta\omega_x=\Delta\omega_\alpha+\Delta\omega_\beta$) is $-2.71\times10^{-3}\ \omega_0$.

The motion in the y direction is determined by $$\ddot{y} + \omega_0^2 y = -\frac{36eqA_3^2}{16mr_0^4} V_{rf} y^3 \tag{34}$$

This gives a shift up in frequency $$\Delta\omega_y = \frac{27A_3^2}{16A_2^2}\frac{b^2}{r_0^2}\omega_0 \tag{35}$$

When $A_2$=1.0, $A_3$=0.020 and b=$r_0$ this shift is $+6.75\times10^{-4}\ \omega_0$, opposite in sign and four times less than the total shift in the x frequency.

A hexapole produces smaller shifts than an octopole of the same amplitude. A positive octopole of amplitude $A_4$ in the X direction produces a shift in frequency of (see reference [9]).

$$\Delta\omega_x = 3\frac{A_4}{A_2}\frac{b^2}{r_0^2}\omega_0 \tag{36}$$

If $A_4$=0.02 and b=$r_0$ this shift is $0.06\omega_0$ or about 22 times greater than that of a hexapole of the same amplitude. Nevertheless the frequency shift from a hexapole should be sufficient to improve MS/MS efficiency. Collings et al. found that MS/MS efficiency for ions of a substituted triazatriphosphorine (m/z=2721.89) was improved significantly under conditions where an added dc octopole field caused a shift of 0.4 kHz from the unperturbed frequency of 59.8 kHz ($\Delta\omega/\omega=6.7\times10^{-3}$). From eq 32 and 33 this frequency shift could be caused by a ca. 3% hexapole field when b=$r_0$ or a ca. 6% hexapole field when b=$r_0$/2.

Methods to Add a Hexapole Field to a Linear Quadrupole

The rod shapes of linear quadrupoles with small amounts of added hexapole fields can be calculated from $$A_2\left(\frac{x^2-y^2}{r_0^2}\right) + A_3\left(\frac{x^3-3xy^2}{r_0^3}\right) = \pm c \tag{37}$$

where c is a constant. Taking $r_0$=1 and c=1 gives $$A_2(x^2-y^2)+A_3(x^3-3xy^2)=\pm1 \tag{38}$$

Equation 38 is quadratic in y, and can be solved to give $$y = \pm\sqrt{\frac{A_3x^3 + A_2x^2 \mp 1}{3A_3x + A_2}} \tag{39}$$

Figure 6:
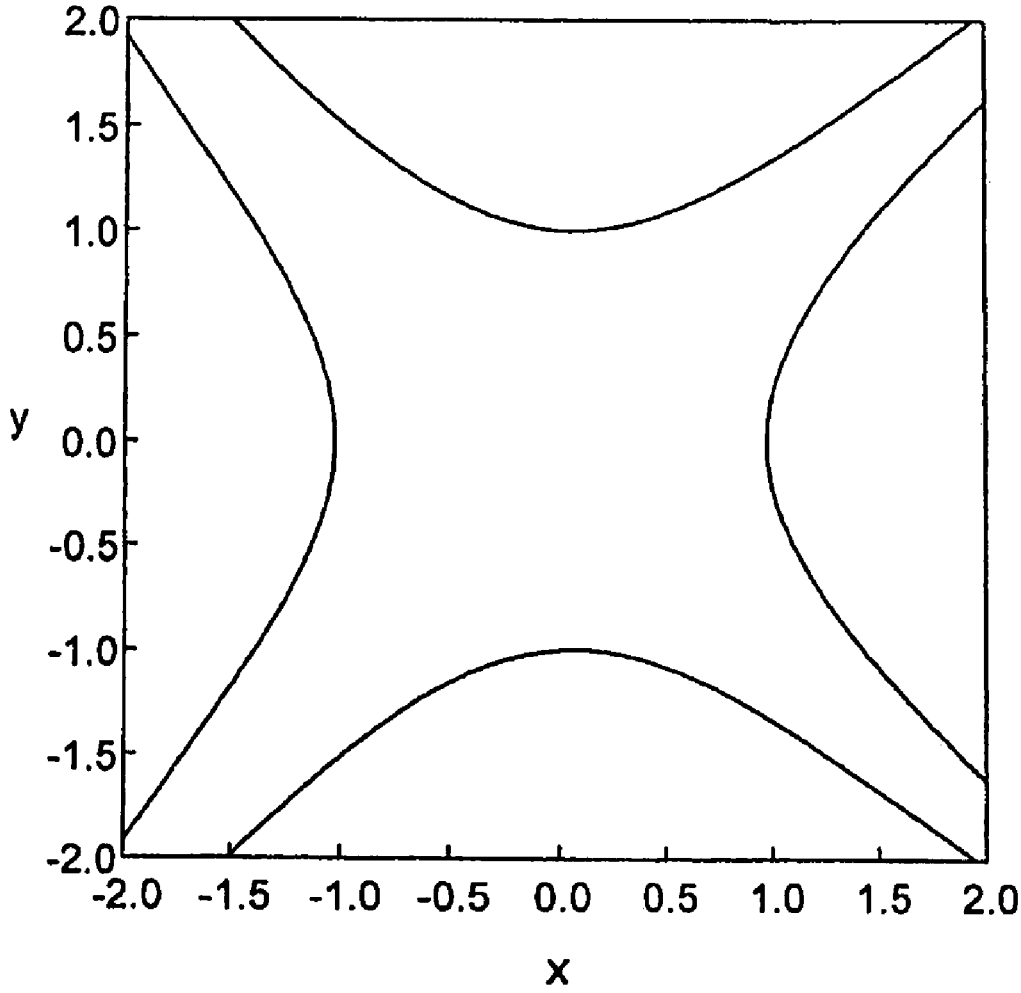
FIG. 6, illustrates cross sections of the electrodes that produce a linear quadrupole field of amplitude $A_2$=1.0 with an added hexapole field of amplitude $A_3$=0.05.

FIG. 6 shows the calculated shapes for −2<x<+2 and −2<y<+2 of the electrodes with $A_2$=1.00 and $A_{3=0.05}$ Electrodes with the exact shapes given by equation 39 produce a quadrupole field with an added hexapole and no other multipoles in the potential. Other multipoles will only be produced by mechanical imperfections.

Equation 37 and FIG. 6 show that with an added hexapole the rods sets are symmetric under the transformation y→−y, but not under the transformation x→−x. This contrasts to rod sets with added octopoles which have fields and electrodes that are symmetric under both of these transformations. Equation 37 shows that changing the sign of $A_3$ is equivalent to the transformation x→−x. Rod sets constructed with a hexapole component $A_3$ and hexapole component $-A_3$ differ only by a reflection in the y axis. Physically the same transformation can be achieved by rotating a rod set 180 degrees about its center to interchange the entrance and exit ends. This gives the same rod set with the same potentials applied to the X and Y rod pairs. The character of ion trajectories and the performance of the rod set will not change. Thus rod sets with $\pm A_3$ are equivalent. This contrasts with rod sets with added octopoles where changing the sign of $A_4$ is equivalent to interchanging the X and Y rods. Because the X and Y rods are physically different and have different applied potentials, changing the sign of $A_4$ changes the character of the ion trajectories (see references [8,9]).

Figure 7:
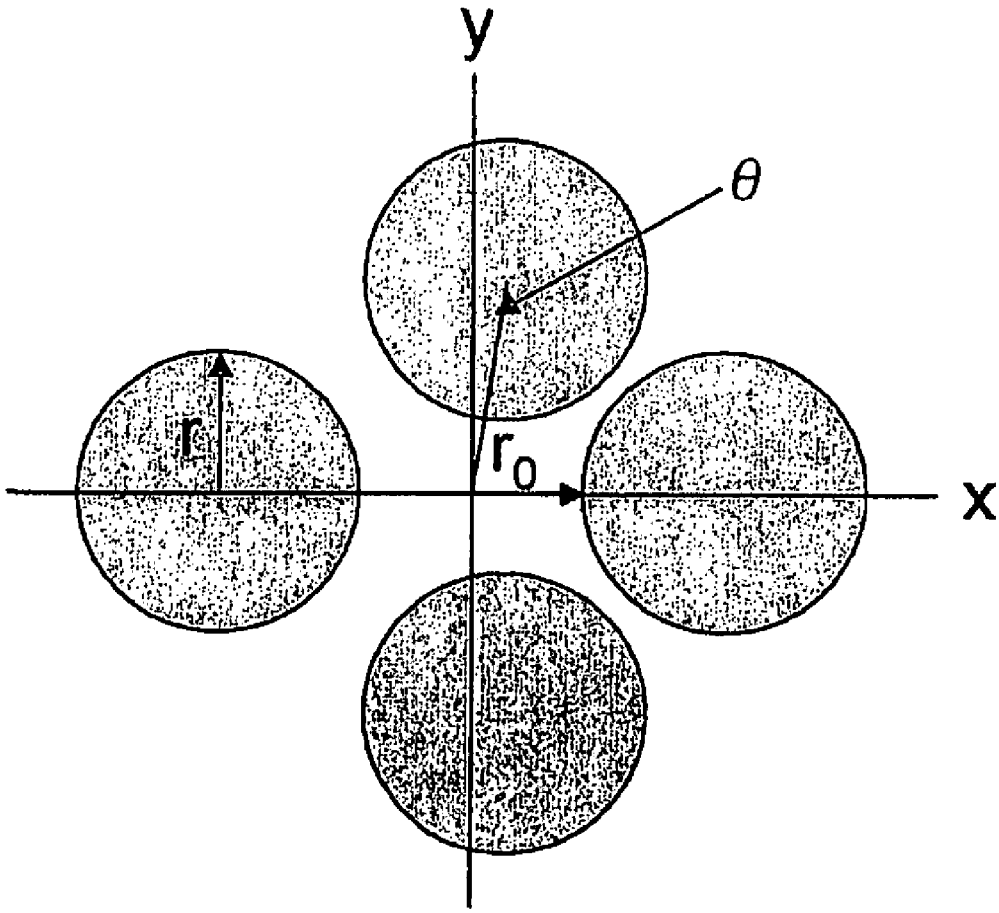
FIG. 7, in a schematic diagram, illustrates an electrode geometry for adding a hexapole field by rotating two Y rods through an angle θ toward an X rod.

Constructing and mounting rod sets with the geometry shown in FIG. 6 with high precision might be difficult and expensive. As with conventional quadrupole rod sets, it is advantageous if the field can be produced with sufficient accuracy with round rods. When round rods are used, an angular displacement of one rod produces an added hexapole field (see "reference [13]"). However the amplitudes of other multipoles are substantial. A hexapole field can be added to a round rod set by rotating the two Y rods toward an X rod, as shown in FIG. 7. In FIG. 7 all rods have the same diameter r and are equally spaced from the axis a distance $r_0$. The two Y rods are rotated through an angle θ toward an X rod.

Figure 8:
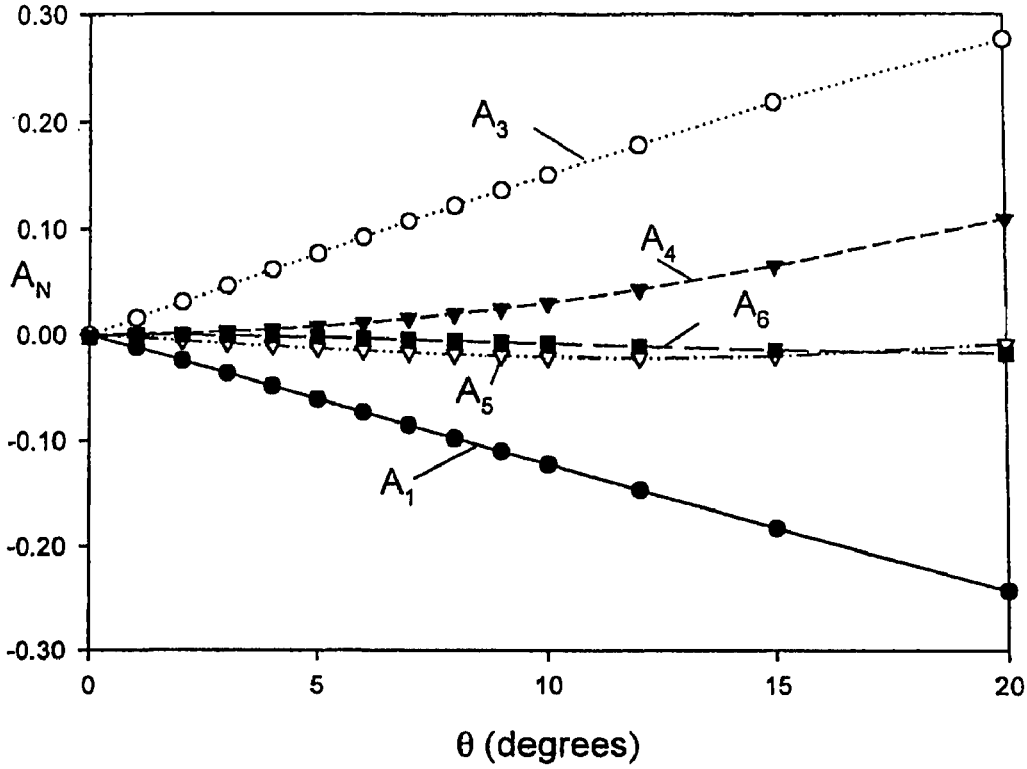
FIG. 8 is a graph plotting multipole amplitudes, $A_N$, vs. rotation angle θ for a rod set with $R/r_0$=1.1487.

FIG. 8 shows the multipole amplitudes $A_1$, $A_3$, $A_4$, $A_5$ and $A_6$ calculated for a ratio $r/r_0$=1.1487 and different angles of rotation, θ. This ratio $r/r_0$ was chosen because it makes the higher order multipole terms small when θ=0 (see March, R. E.; Hughes, R. J. *Quadrupole Storage Mass Spectrometry*, John Wiley and Sons, Toronto p. 42 (hereinafter "reference [23]")). The effects of small changes in $r/r_0$ when 0=0 have been reviewed by Douglas and Konenkov (see reference [18]). These amplitudes are shown because they are the largest produced with this rod geometry. It can be seen that a hexapole component is produced with amplitude approximately proportional to the rotation angle, given by $A_3$=0.01545θ. At the same time a dipole component $A_1$ is produced. Other higher harmonics remain relatively small. Table 1, for example shows the harmonics produced with a rotation angle of 3.0°.

TABLE 1

AMPLITUDES OF MULTIPOLES PRODUCED WITH ROUND RODS, $R/r_0$ = 1.1487 AND A ROTATION ANGLE OF 3 DEGREES

| Multipole | Amplitude |
|---|---|
| $A_0$ | $3.73\times10^{-5}$ |
| $A_1$ | $-3.68\times10^{-2}$ |
| $A_2$ | 1.0011 |
| $A_3$ | $4.64\times10^{-2}$ |
| $A_4$ | $2.77\times10^{-3}$ |
| $A_5$ | $-8.18\times10^{-3}$ |
| $A_6$ | $-1.098\times10^{-3}$ |
| $A_7$ | $-1.43\times10^{-3}$ |
| $A_8$ | $-1.54\times10^{-4}$ |
| $A_9$ | $5.00\times10^{-4}$ |
| $A_{10}$ | $-2.29\times10^{-3}$ |

The Dipole Term $A_1$

FIG. 8 and Table 1 (as shown above) show that with the geometry of FIG. 7, there is a significant dipole term, $A_1$. (The dipole term in the potential has the form $$A_1\left(\frac{x}{r_0}\right)\varphi(t).)$$

This term arises because the field is no longer symmetric about the Y axis 119. The dipole term can be removed by applying different voltages to the two X rods, either with a larger voltage applied to the X rod in the positive X direction or a smaller voltage applied to the X rod in the negative X direction, or a combination of these changes (see Douglas, D. J.; Ding, C-F.; Londry F. Method and Apparatus For Providing Two-Dimensional Substantially Quadrupole Fields Having Selected Hexapole Components, U.S. Pat. No. 7,141,789 (hereinafter "reference [24]")).

The dipole term arises because the centre of the field is no longer at the point x=0, y=0 of FIG. 7. The potential is approximately given by $$V(x, y, t) = \left[A_1\left(\frac{x}{r_0}\right) + A_2\left(\frac{x^2 - y^2}{r_0^2}\right) + A_3\left(\frac{x^3 - 3xy^2}{r_0^3}\right)\right]\varphi(t) \tag{40}$$

Let $\hat{x}=x+x_0$ or $x=\hat{x}-x_0$. Then $$\frac{V(\hat{x}, y, t)}{\varphi(t)} = A_1\left(\frac{(\hat{x}-x_0)}{r_0}\right) + A_2\left(\frac{(\hat{x}-x_0)^2 - y^2}{r_0^2}\right) + A_3\left(\frac{(\hat{x}-x_0)^3 - 3(\hat{x}-x_0)y^2}{r_0^3}\right) \tag{41}$$

Expanding the terms gives $$\frac{V(\hat{x}, y, t)}{\varphi(t)} = A_3\left(\frac{\hat{x}^3}{r_0^3}\right) + \left(\frac{A_2}{r_0^2} - \frac{3x_0A_3}{r_0^3}\right)\hat{x}^2 + \left(\frac{A_1}{r_0} - \frac{2x_0A_2}{r_0^2} + \frac{3x_0^2A_3}{r_0^3} - \frac{3y^2}{r_0^3}\right)\hat{x} + \left(\frac{-A_1x_0}{r_0} + \frac{A_2x_0^2}{r_0^2} - \frac{A_3x_0^2}{r_0^3}\right) \tag{42}$$

Consider the coefficient of $\hat{x}$ when y=0. This will be zero if $$\frac{A_1}{r_0} - \frac{2x_0A_2}{r_0^2} + \frac{3x_0^2A_3}{r_0^3} = 0 \tag{43}$$

The last term is much smaller than the first two, so to a good approximation the coefficient of the dipole is zero if $$\frac{A_1}{r_0} - \frac{2x_0A_2}{r_0^2} = 0 \tag{44}$$

or

-continued $$x_0 = \frac{A_1r_0}{2A_2} \tag{45}$$

More exactly eq 43 is quadratic in $x_0$ and can be solved to give $$x_0 = \frac{\frac{2A_2}{r_0^2} \pm \sqrt{\frac{4A_2^2}{r_0^4} - 4\frac{A_1}{r_0}\frac{3A_3}{r_0^3}}}{2\frac{3A_3}{r_0^3}} \tag{46}$$

It is the solution with the minus sign that is realistic. Table 2 below shows the approximate and exact values of $x_0$ calculated from eq 45 and eq 46 respectively for three rotation angles which give nominal hexapole fields of 4, 8, and 12%.

TABLE 2

COMPARISON OF VALUES OF $x_0$ FROM THE APPROXIMATE EQ 45 AND THE EXACT EQ 46

| θ (degrees) | $A_1$ | $A_2$ | $A_3$ | $x_0$ from eq 45 | $x_0$ from eq 46 |
|---|---|---|---|---|---|
| 2.56 | −0.0314 | 1.001 | 0.0396 | −0.0157 $r_0$ | −0.0156$r_0$ |
| 5.13 | −0.0629 | 0.9975 | 0.0789 | −0.0315 $r_0$ | −0.0313$r_0$ |
| 7.69 | −0.0942 | 0.9906 | 0.1172 | −0.0471 $r_0$ | −0.0467$r_0$ |

Because $A_1<0$, $x_0<0$. e.g. $\hat{x}=x-0.0315r_0$ When $\hat{x}=0$, $x=+0.0315r_0$. When x=0, $\hat{x}=-0.0315r_0$. The centre of the field is shifted in the direction of the positive x axis. This calculation is still approximate because it does not include the higher multipoles. However it is likely adequate for practical purposes.

In the co-ordinate system centered on $\hat{x}=0$, the multipoles differ somewhat from the multipoles shown in FIG. 8 and Table 1. In the $\hat{x}$ co-ordinate system the coefficient of $\hat{x}^2$ is $$\left(\frac{A_2}{r_0^2} - \frac{3x_0A_3}{r_0^3}\right)^2. \tag{47}$$

e.g. for an 8% hexapole (θ=5.13°), $A_1=-0.0629$, $A_3=0.0789$, and the coefficient changes from $A_2=0.99738$ to 1.00+1.5 (0.0629)(0.0789)=1.0074. A slight difference in the quadrupole term. Table 3 below shows the multipoles for a rotation angle of θ=3.85 degrees, (nominal 6% hexapole) in a co-ordinate system centered on x=0, y=0 and in the coordinate system centered on $\hat{x}=0$, y=0.

TABLE 3

MULTIPOLE AMPLITUDES IN A CO-ORDINATE SYSTEM CENTERED ON X = 0, Y = 0 AND IN A CO-ORDINATE SYSTEM THAT MAKES $A_1$ = 0 WITH $R/r_0$ = 1.1487, AND θ = 3.85 DEGREES.

| multipole | amplitude (x = 0, y = 0) | amplitude $\hat{x}$ = 0, y = 0 |
|---|---|---|
| $A_0$ | $6.15 \times 10^{-5}$ | $-4.89 \times 10^{-4}$ |
| $A_1$ | $-4.72 \times 10^{-2}$ | 0.000 |
| $A_2$ | 0.9999 | 1.004 |
| $A_3$ | $5.94 \times 10^{-2}$ | $5.98 \times 10^{-2}$ |

TABLE 3-continued

MULTIPOLE AMPLITUDES IN A CO-ORDINATE SYSTEM CENTERED ON X = 0, Y = 0 AND IN A CO-ORDINATE SYSTEM THAT MAKES $A_1 = 0$ WITH $R/r_0 = 1.1487$, AND $\theta = 3.85$ DEGREES.

| multipole | amplitude (x = 0, y = 0) | amplitude $\hat{x}$ = 0, y = 0 |
|---|---|---|
| $A_4$ | $4.56 \times 10^{-3}$ | $3.32 \times 10^{-3}$ |
| $A_5$ | $-1.04 \times 10^{-2}$ | $-1.06 \times 10^{-2}$ |
| $A_6$ | $-1.64 \times 10^{-3}$ | $-1.96 \times 10^{-3}$ |
| $A_7$ | $-1.89 \times 10^{-3}$ | $-1.9310^{-3}$ |
| $A_8$ | $-2.60 \times 10^{-4}$ | $-1.83 \times 10^{-4}$ |
| $A_9$ | $6.28 \times 10^{-4}$ | $9.1 \times 10^{-4}$ |
| $A_{10}$ | $-2.18 \times 10^{-3}$ | $-2.37 \times 10^{-3}$ |

First simulations of peak shapes and transmission with the thermalized ion source and a co-ordinate system centered on x=0, y=0 including the dipole term, showed very low transmission. When the dipole term was not included, the transmission increased significantly. Therefore all the calculations of peak shapes and transmission for round rod sets shown below were done with multipoles calculated for the co-ordinate system that makes the dipole term zero. Experimentally this can be done by injecting the ions at the point $\hat{x}$=0, y=0. For an ion source which has a spatial spread much greater than $x_0$, it may not be necessary to center the source at $\hat{x}$=0. For example in Table 2 with $\theta$=5.13 degrees and $A_3$=0.0789, $\hat{x}=0.0313r_0$. For a typical value of $r_0$ of 4.5 mm, $x_0$=0.1364 mm. A typical source might have a radius of 1.0 to 2.0 mm so ions are introduced over a large region that includes $\hat{x}$=0. However with a source with a much smaller spatial spread such as the source used in the modeling here, it is preferable to inject the ions at the field center where the dipole term is zero.

Mass Analysis

The addition of higher multipoles to a linear quadrupole operated as a mass filter has generally been considered undesirable (see (a) Dawson, P. H.; Whetton, N. R. Non-linear Resonances in Quadrupole Mass Spectrometers Due to Imperfect Fields, *Int. J. Mass Spectrom. Ion Phys.* 1969, 3, 1-12. (b) Dawson P. H. Ion Optical Properties of Quadrupole Mass Filters. *Advances in Electronics and Electron Optics* 1980, 53, 152-208). Nevertheless it has recently been shown that linear quadrupoles with substantial added octopole fields ($A_4$=0.02-0.04) can in fact be operated as mass filters (see reference [11]). We then investigated the possibility of using quadrupoles with added hexapole fields as mass filters.

Figure 9:
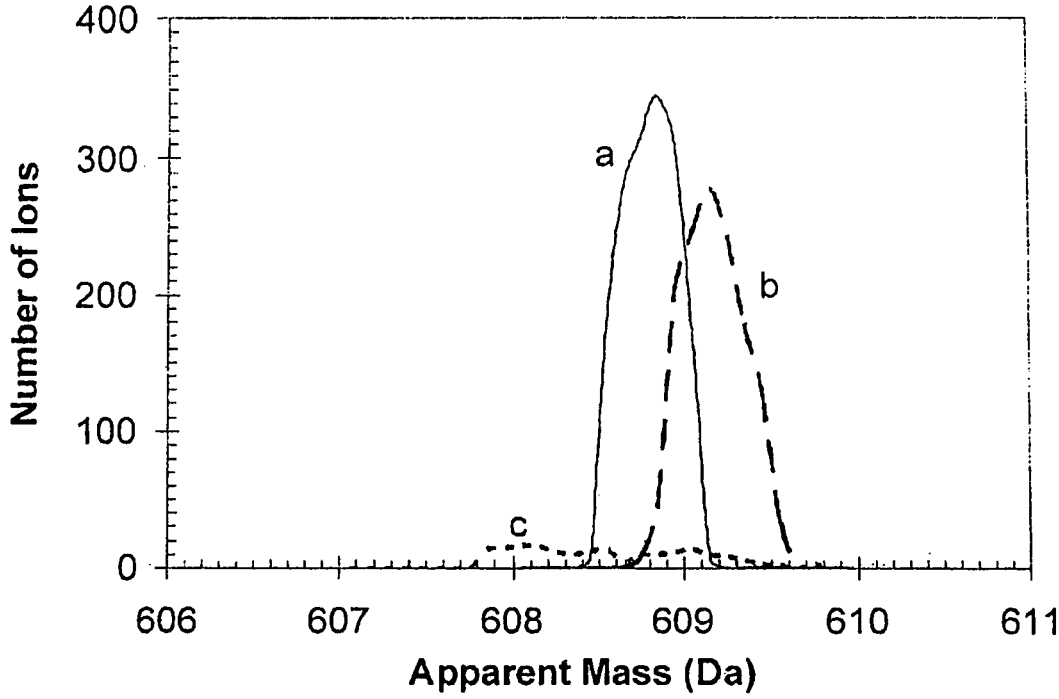
FIG. 9, in a graph, illustrates peak shapes obtained (a) with a pure quadrupole field, λ=0.1667; (b) with a quadrupole field with 2% added hexapole and λ=+0.1680; (c) with a quadrupole field with 2% added hexapole and λ=−0.1665.

FIG. 9 shows calculated peak shapes for positive ions. Curve "a" shows a peak shape calculated for a pure quadrupole field and $\lambda$=+0.1667. For the simulations of FIG. 9, 10,000 ions were uniformly distributed over a circular aperture of radius 0.1 mm ($0.024r_0$) with thermal (300K) radial speeds. Ions of m/z=609 were injected into a 200 mm long quadrupole with an additional 1.0 eV of energy (speed 561 $ms^{-1}$, 356 cycles in the 1.0 MHz field). The ions were distributed randomly and uniformly along a scan line of nominal resolution 1000, corresponding to masses of 608.2 to 610.2. The peak from the pure quadrupole field shows a peak width at half height of $\Delta m/z$=0.53 ($R_{1/2}$=1150). FIG. 9 curve b shows the peak shape obtained when a 2% hexapole ($A_3$=0.02) is added to the quadrupole potential, and the positive dc is applied to the X rods and the negative DC to the Y rods. Higher multipoles are not included in the calculation; the potential is given by eq 11. Preliminary results had shown that with an added hexapole a broader peak with lower resolution is obtained in comparison to a pure quadrupole operated at the same value of $\lambda$. For curve b, $\lambda$ was increased to 0.1680 to give a peak shape with resolution comparable to that of the pure quadrupole field. This scan line does not intersect the tip of the stability region of a pure quadrupole field. FIG. 9 shows that when there is a 2% hexapole field and $\lambda$=0.1680 the resolution ($R_{1/2}$=1130) and peak shape are comparable to those of a pure quadrupole field. Curve c shows the peak shape and transmission when the polarity of the DC is reversed (positive DC on the Y rods and negative DC on the X rods). For this calculation the magnitude of $\lambda$ was lowered to 0.1665 in an attempt to increase the transmission. The peak is broad and the transmission is very low. Thus mass analysis with good peak shape, resolution and transmission is possible with a quadrupole field with added hexapole field but the DC must be applied with the correct polarity. This is analogous to mass analysis with an added octopole field (see reference [11]).

Figure 10A:
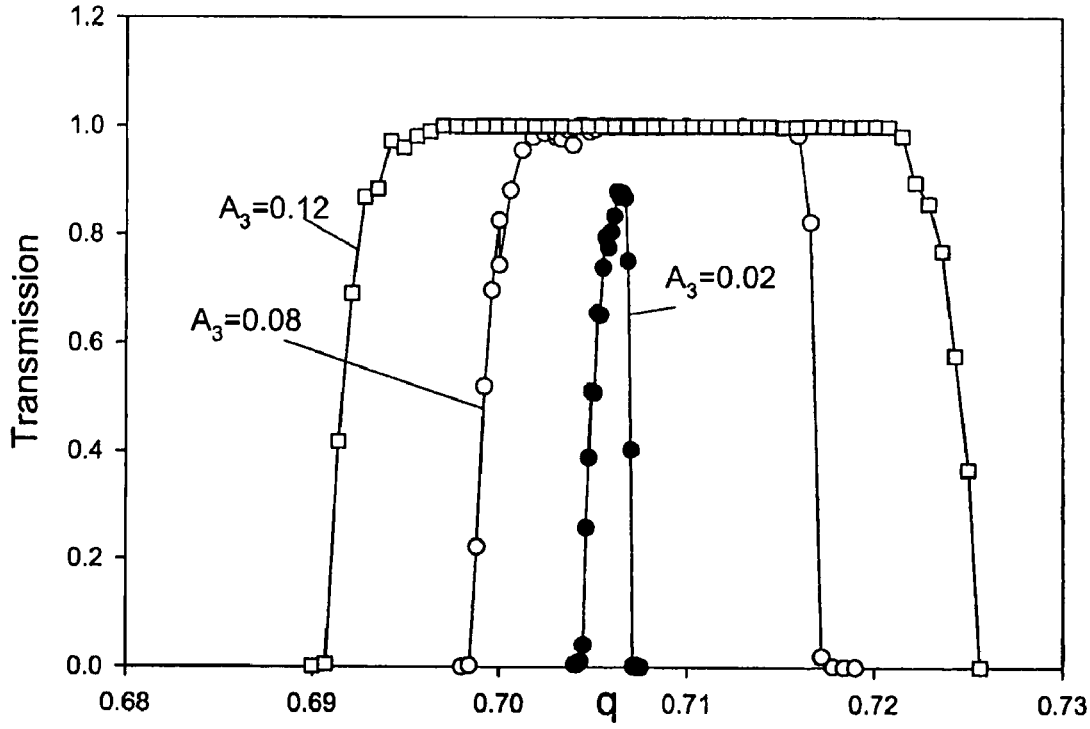
FIG. 10, in graphs, illustrates (a) peak shapes for a quadrupole field with added hexapole components of 2, 8 and 12% with $\sigma_x$=0.002$r_0$, $\sigma_v$=0.007, λ=0.1676 and 100 cycles in the field; (b) at higher resolution and with 150 cycles in the field, with $A_3$=0.02, λ=0.1680, with $A_3$=0.08 λ=0.1706 and with $A_3$=0.12, λ=0.1730.
Figure 10B:
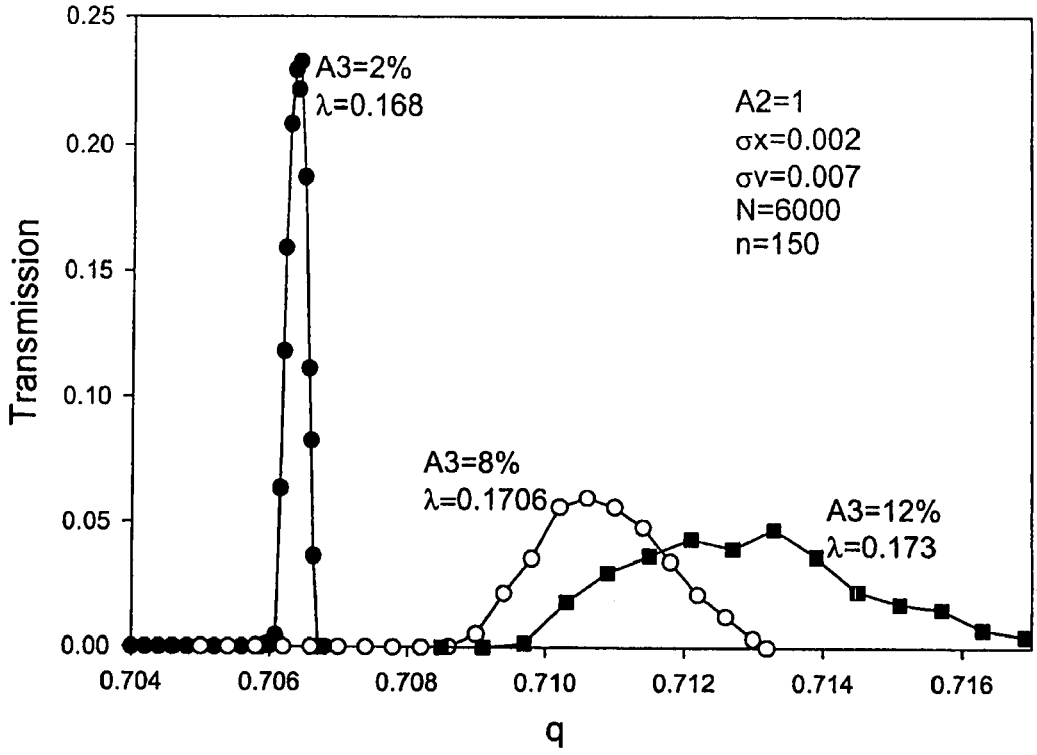

FIG. 10*a* shows peak shapes for positive ions and a>0 for quadrupoles with 2%, 8% and 12% added hexapole fields with no other multipoles, with $\lambda$=0.1676. With increasing amounts of hexapole the peak broadens but remains smooth with sharp sides. The broadening results from changes to the stability diagram described below. As the amplitude of the hexapole increases, the transmission increases. FIG. 10*b* shows peak shapes with 2%, 8%, and 12% added hexapole field and with $\lambda$ increased to increase the resolution. The resolution with a 2% hexapole field is ca. 1800, with 8% hexapole 300, and with 12% hexapole 180. The $\lambda$ values for the different scans are shown below.

| $A_3$ | $\lambda$ |
|---|---|
| 0.02 | 0.1680 |
| 0.08 | 0.1706 |
| 0.12 | 0.1730 |

Peak Shapes with Round-Rod Sets

Figure 11:
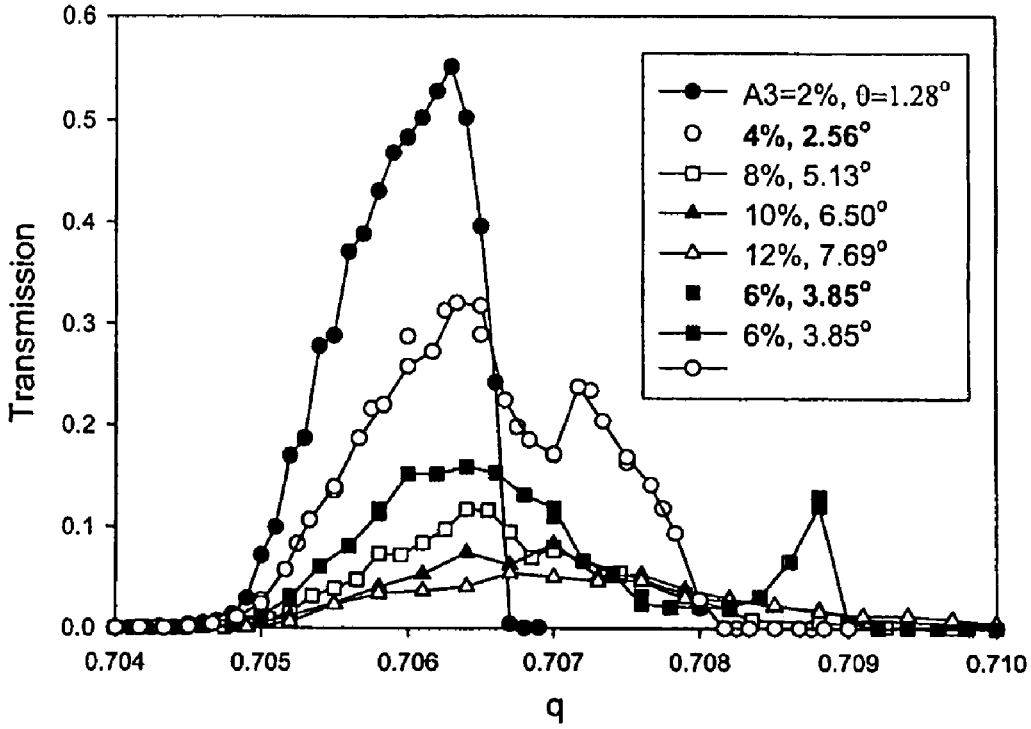
FIG. 11, in a graph, illustrates peak shapes with $R/r_0$=1.1487 and round rods with nominal hexapole components of 2, 4, 6, 8, 10 and 12% constructed from round rods, with $\sigma_x$=0.002$r_0$, $\sigma_v$=0.007, λ=0.1676, 150 rf cycles in the field.

The simulations of FIGS. 9, 10*a* and 10*b* include no multipoles higher than the hexapole. When round rods are used as in FIG. 7, other multipoles are added to the field. FIG. 11 shows peak shapes calculated for positive ions and a>0 for quadrupoles constructed with round rods with $A_4 \neq 0$, and $\lambda$=0.1676. For this calculation all the multipoles up to N=10 in the coordinate system that makes $A_1$=0 were included. As the hexapole component increases, the transmission decreases, and the resolution drops from $R_{1/2}$=370 when $A_3$=0.02 to $R_{1/2}$=300 when $A_3$=0.12. The transmission when $A_3$=0.12 drops from nearly 100% (FIG. 10*a*) to less than 10%. In addition, there is undesirable structure on the peak. Clearly the higher multipoles affect the transmission and resolution.

Peak Shapes with $A_4 \approx 0$

After $A_1$ and $A_3$, the next highest term in the multipole expansion is the octopole term (FIG. 8). The $A_4$ term is inadvertently added when one pair of rods is rotated toward one rod in the other pair of rods to add a hexapole component. This term can be minimized by constructing the rod sets with different diameters for the X and Y rods. For a given rotation angle, the diameter of the X rods can be increased to make $A_4 \approx 0$. These diameters are shown in Table 4.

TABLE 4

VALUES OF $R_x/r_0$ THAT GIVE $A_4 \approx 0$

| nominal $A_3$ | angle (degrees) | $A_3$ | $A_4$ | new $R_x/r_0$ to make $A_4 = 0$ | $A_4$ with new $R_x$ |
|---|---|---|---|---|---|
| 2% | 1.28 | 0.0198299 | 0.0005060 | 1.1540 | $5.62 \times 10^{-5}$ |
| 4% | 2.56 | 0.0396057 | 0.0020210 | 1.1730 | $1.38 \times 10^{-5}$ |
| 6% | 3.85 | 0.0594268 | 0.0045593 | 1.2050 | $5.05 \times 10^{-6}$ |
| 8% | 5.13 | 0.0789318 | 0.0080662 | 1.2500 | $2.51 \times 10^{-5}$ |
| 10% | 6.50 | 0.099569 | 0.0128860 | 1.3185 | $3.54 \times 10^{-6}$ |
| 12% | 7.69 | 0.1172451 | 0.0179422 | 1.4000 | $1.75 \times 10^{-4}$ |

When both of the Y rods are rotated toward one of the X rods to add the selected hexapole, an octopole component is also added. Based on the data of Table 4, the increase in the radius of the X rods relative to the Y rods required to substantially eliminate the octopole component added can be determined as a function of the rotation of the Y rods, and hence as a function of the hexapole added. For example, if the Y rods are rotated toward one of the X rods such that the magnitude of $A_3$ is approximately 2% of the magnitude of $A_2$, then the octopole component can be substantially eliminated if the X rods are approximately 0.4% larger in diameter than the Y rods. If the rotation of the Y rods is sufficient to provide a magnitude of $A_3$ that is about 4% of the magnitude of $A_2$, then the octopole component can be substantially eliminated if the X rods are approximately 2% larger in diameter than the Y rods. If the rotation of the Y rods toward one of the X rods results in the magnitude of $A_3$ being approximately 6% of the magnitude of $A_2$, then the octopole component can be substantially eliminated if the X rods are approximately 4% larger in diameter than the Y rods. If the Y rods are rotated toward one of the X rods such that the magnitude of $A_3$, is approximately 8% of the magnitude of $A_2$, then the octopole component can be substantially eliminated if the X rods are approximately 8% larger in diameter than the Y rods. If the Y rods are rotated toward one of the X rods to provide a magnitude of $A_3$ that is about 10% of the magnitude of $A_2$, then the octopole component can be substantially eliminated if the X rods are about 14% larger in diameter than the Y rods. If the Y rods are rotated toward one of the X rods to provide a magnitude of $A_3$ that is 12% of the magnitude of $A_2$, then the octopole component can be substantially eliminated if the X rods are about 20% larger in diameter than the Y rods. Of course, other values may also be calculated.

Figure 12A:
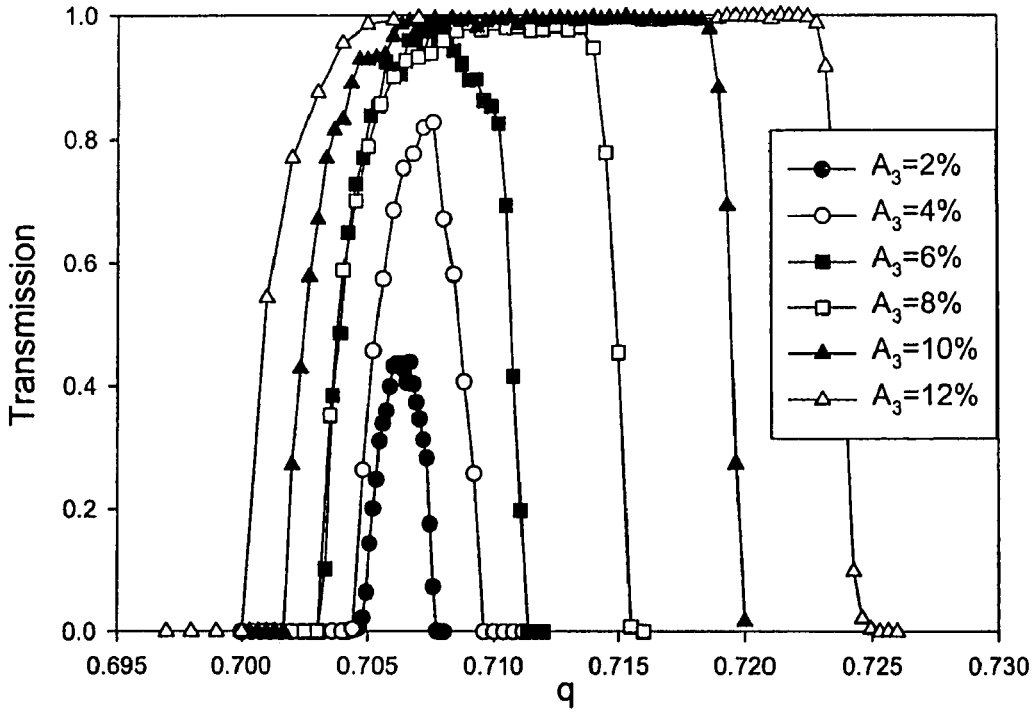
FIG. 12, in graphs, illustrates (a) peak shapes with round rods, with $A_3$ from 0.02 to 0.12 and $R_x/r_0$ chosen to minimize $A_4$, calculated with $A_1$=0 and with $\sigma_x$=0.002$r_0$, $\sigma_v$=0.007, λ=0.1676 and 150 rf cycles in the field; (b) peak shapes with $A_1$=0 and $A_4$≈0 at higher resolution with rod sets with added hexapole fields of 6, 8, 10, and 12% operated at λ=0.16857, λ=0.1692, λ=0.1705 and λ=0.1715 respectively; (c) peak shapes with $A_1$≈0 and $A_4$=0 at intermediate resolution with rod sets with an added hexapole field of approximately 12% operated at different values of λ; (d) peak shapes with $A_1$≈0 and $A_4$=0 at intermediate resolution with rod sets with an added hexapole field of approximately 10% operated at different values of λ.
Figure 12B:
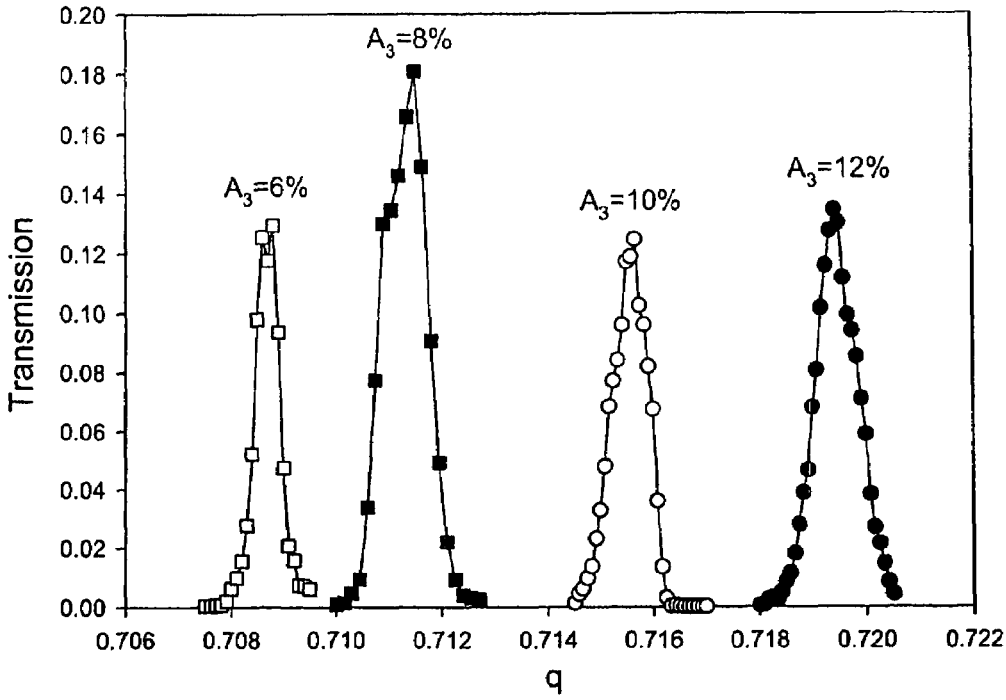
Figure 12C:
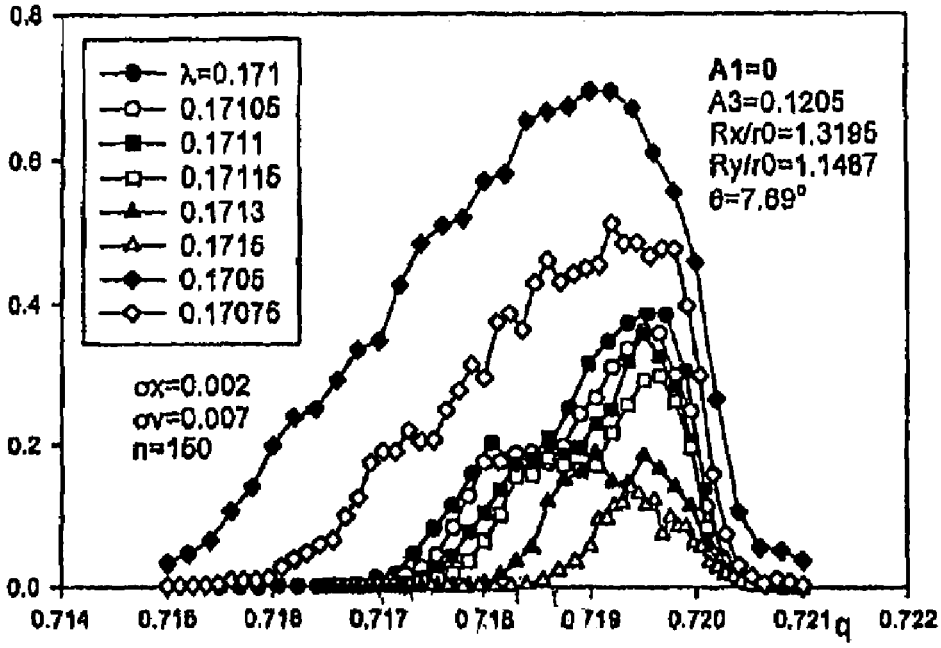
Figure 12D:
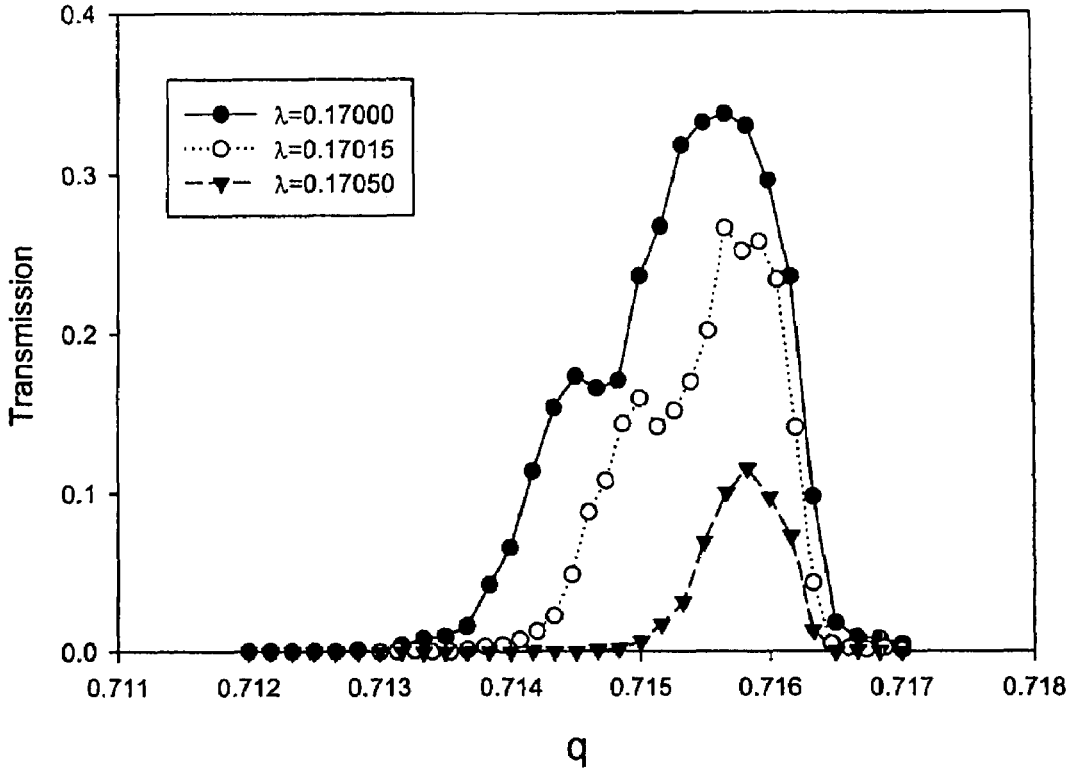

When $A_4$ is minimized, the peak shape improves. FIG. 12*a* shows peak shapes for positive ions and a>0 calculated with $\lambda$=0.1676 and the geometries that minimize $A_4$. In comparison to round rod sets with $A_4 \neq 0$ (FIG. 11) the transmission is greatly improved. At these low resolutions the peak shapes are similar to those of a quadrupole with a pure added hexapole only (FIG. 10*a*). When $\lambda$ is increased, the resolution increases. FIG. 12*b* shows peak shapes with a nominal hexapole components of 6, 8, 10, and 12%, and with scan lines chosen to give increased resolution. At low resolution the transmission is high and peak shape smooth (FIG. 12*a*). FIG. 12*c* illustrates QMF transmission counters with added hexapole field amplitude $A_3$=0.1205 for different values of the scan parameter $\lambda$. The ion source has been adjusted to have an axis of zero axial potential. Spatial harmonics for the round rod set are calculated relative to the axis where $A_0$=0. It can be seen from FIGS. 12*a* and 12*b* that making $A_4$=0 improves the peak shape. However, at intermediate resolution there can still be structure of the peaks. This is illustrated in FIG. 12*d* which shows peak shapes for a quadrupole with nominally 10% hexapole and $A_4 \approx 0$. More specifically, $\theta$=6.5°, $A_3$=0.1016, $r_x/r_0$=1.2672. $r_y/r_0$=1.1487 calculated with $\sigma_x$=0.002, $\sigma_y$=0.007, and 150 cycles in the field. The two peaks with $\lambda$=0.17000 and X=0.17015 with intermediate resolution have dips on the low mass side. As shown in FIGS. 12*c* and 12*d*, at intermediate resolution there is split peak like that of the peak for $A_3$=4% in FIG. 11. At higher resolution (FIG. 12*b*) there is again a smooth peak. In FIG. 12*b* the peak for the 6% added hexapole shows the highest resolution with $R_{1/2} \approx 1400$. The other peaks have $R_{1/2}$=700-800. The peaks with 8 and 12% hexapole have both transmission and resolution about twice that of equal diameter rod sets where $A_4 \neq 0$ (FIG. 11) and also show higher transmission and resolution than a quadrupole with only an added hexapole of the same amplitude (FIG. 10*b*).

Stability Diagrams

Figure 13:
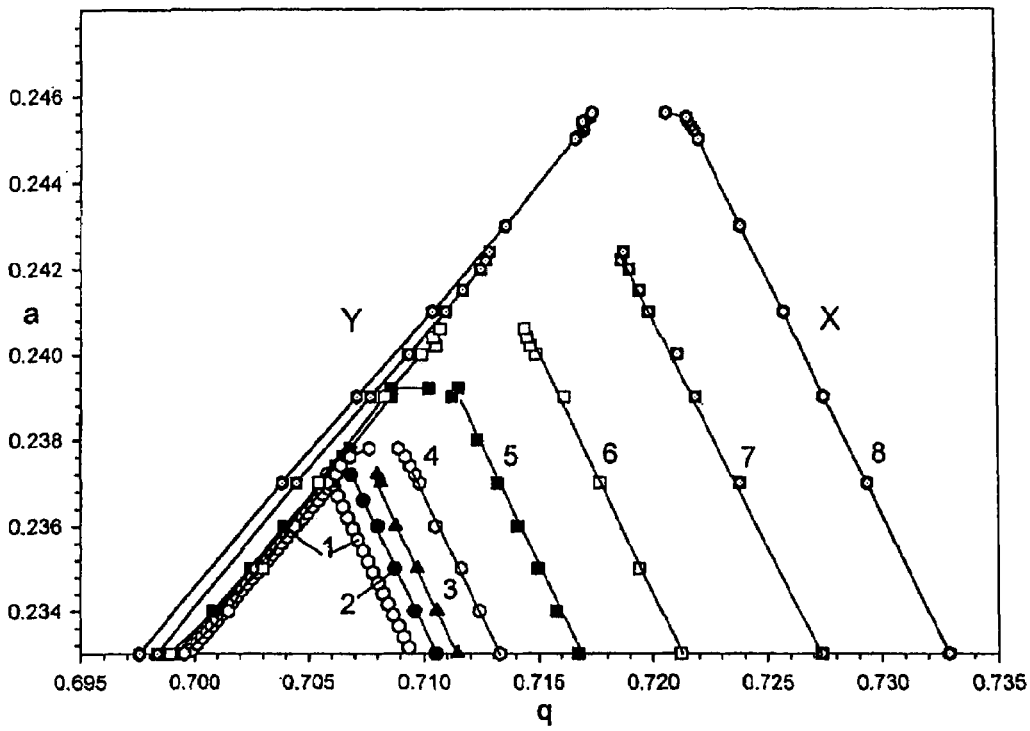
FIG. 13, in a graph, illustrates stability boundaries calculated for 1% transmission with 150 rf cycles in the field (1) for a pure quadrupole field (2) for a quadrupole with 2% hexapole but no other multipoles, and for rod sets constructed with round rods that minimize $A_4$, calculated with $A_1$=0, for (3) 2% hexapole (4) 4% hexapole (5) 6% hexapole (6) 8% hexapole (7) 10% hexapole and (8) 12% hexapole.

Adding a hexapole field to a linear quadrupole causes the stability boundaries to shift. Calculated stability boundaries for a>0 (positive dc applied to the x rods and positive ions) are shown in FIG. 13. The lines labeled 1 are the boundaries for an ideal quadrupole field. Line 2 shows the x boundary for a field with a quadrupole ($A_2$=1.00) and hexapole ($A_3$=0.02) but no other multipoles. The hexapole harmonic leads to a shift of the x boundary along the q axis, parallel to the original boundary. The addition of higher order spatial harmonics created by round rods gives additional shifts to the x boundary. Curve 3 shows the x boundary calculated for a rod set with nominal 2% hexapole field and the harmonics up to N=10. Curves 4, 5, 6, 7, 8 correspond to boundaries of rod sets constructed from round rods and with added hexapoles of 4, 6, 8, 10 and 12% created by round rods. For the calculations of boundaries 2-8 the multipole amplitudes of rod sets that minimize $A_4$ were used, and the co-ordinate system that makes $A_1$=0 was used. Increasing the amplitude $A_3$ leads to strong shifts of the x boundary and increased areas of stability regions. These shifts explain the increases in peak widths for a constant $\lambda$ as the hexapole component increases. (FIGS. 10*a*, 11, 12*a*). They also explain the need for using higher values of x as the hexapole amplitude increases (FIG. 12*b*) and the shift of peaks to higher q values as the hexapole component increases (FIG. 12*b*). Attempts were made to calculate the stability diagram when a<0 (negative DC applied to the x rods, positive ions). Only a diffuse island of stability with very low transmission was found. This is consistent with the low transmission and poor resolution of curve c in FIG. 9.

The x boundary shows the greatest shift because it is the electric field in the x direction that changes the most with an added hexapole. Using eq 11, the electric fields are given by $$E_x = -\frac{\partial V(x, y, t)}{\partial x} = \left[-\frac{2A_2}{r_0^2}x - \frac{3A_3}{r_0^3}x^2 + \frac{3A_3}{r_0^3}y^2\right]\varphi(t); \tag{48}$$

$$E_y = -\frac{\partial V(x, y, t)}{\partial y} = \left[\frac{2A_2}{r_0^2}y + \frac{6A_3}{r_0^3}xy\right]\varphi(t). \tag{49}$$

Considering the x direction y=0 and the y direction x=0 eq 48 and 49 can be written as $$E_x = \left[-\frac{2A_2}{r_0^2}x\left[1+\frac{3A_3}{2A_2r_0}x\right]\right]\varphi(t); \quad (50)$$

$$E_y = \left[\frac{2A_2}{r_0^2}y\right]\varphi(t). \quad (51)$$

Equations 50 and 51 show that the x electric field depends on the amplitude $A_3$ and that the y electric field is unchanged. This is approximate because the coupling of the x and y motion is not included in eq 50 and 51.

In some embodiments, a hexapole field on the order of 1-10% of the quadrupole field can be added to a linear ion trap by constructing the electrodes with exact geometries or by using round rods with the two Y rods rotated towards an X rod. Calculations of the frequency shifts caused by these fields suggest they should be sufficient to improve the MS/MS efficiency. If the same rod set is to be used for mass analysis the improved performance would seem to come from rod sets constructed with round rods where the X rods are increased in diameter to make the octopole term in the potential small, and with injection of the ions on the field center where the dipole term is zero. Simulations of the stability diagram for these rod sets show that the stability boundaries move out but remain sharp provided the positive DC potential is applied to the X rods (for positive ions).

Embodiments of the invention have been described in terms of mass analysis of positive ions. For mass analysis of negative ions, the positive DC should preferably be applied to the Y rods and the negative DC to the X rods. That is, the polarity of the DC should be reversed. This has been described for quadrupoles with added octopole fields in reference [11] and U.S. Pat. No. 6,897,438.

Other variations and modifications of the invention are possible. All such modifications or variations are believed to be within the sphere and scope of the invention as defined by the claims appended hereto.

The invention claimed is:

1. A mass spectrometer comprising (a) a quadrupole electrode system for connection to a voltage supply means for providing an at least partially-AC potential difference within the quadrupole electrode system, the quadrupole electrode system having (i) a quadrupole axis; (ii) a first pair of rods; (iii) a second pair of rods, wherein each rod in the first pair of rods and the second pair of rods is spaced from and extends alongside the quadrupole axis and is substantially cylindrical; (iii) a voltage connection means for connecting at least one pair of the first pair of rods and the second pair of rods to the voltage supply means to provide the at least partially-AC potential difference between the first pair of rods and the second pair of rods such that in use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$ and a hexapole harmonic with amplitude $A_3$ wherein the magnitude of $A_3$ is greater than 0.1% of the magnitude of $A_2$; and (b) an ion source for injecting ions substantially centered along a field centre of the two-dimensional substantially quadrupole field, wherein the field centre is spaced from the quadrupole axis such that a dipole potential of the two-dimensional substantially quadrupole field is lower along the field centre than along the quadrupole axis.

2. The mass spectrometer as defined in claim 1 wherein i) the ion source is positioned relative to the quadrupole axis to inject ions along the field centre; and, ii) the dipole potential has a magnitude $A_1$ at the field centre, the magnitude of $A_1$ being less than 0.1% of the magnitude of $A_2$.

3. The mass spectrometer as defined in claim 1 wherein in the quadrupole electrode system, (i) the second pair of rods is closer to one rod in the first pair of rods than to the other rod in the first pair of rods; (ii) the rods of the second pair of rods are closer together than the rods of the first pair of rods; and, (iii) all of the rods are equidistant from the quadrupole axis.

4. The mass spectrometer as defined in claim 3 wherein the voltage supply means is operable to provide a selected positive DC voltage to the first pair of rods relative to the second pair of rods for mass selection of positive ions; and, a selected negative DC voltage to the first pair of rods relative to the second pair of rods for mass selection of negative ions.

5. The mass spectrometer as defined in claim 4 wherein the magnitude of $A_3$ is greater than 1% and is less than 15% of the magnitude of $A_2$.

6. The mass spectrometer as defined in claim 4 wherein the magnitude of $A_3$ is greater than 1% and is less than 8% of the magnitude of $A_2$.

7. The mass spectrometer as defined in claim 3 wherein the substantially quadrupole field has an octopole harmonic with amplitude $A_4$, and the magnitude of $A_4$ is less than 0.1% of the magnitude of $A_2$.

8. The mass spectrometer as defined in claim 7, wherein the first pair of rods are larger in diameter than the second pair of rods.

9. The mass spectrometer as defined in claim 8 wherein the magnitude of $A_3$ is greater than 2% of the magnitude of $A_2$ and the first pair of rods are at least 0.4% larger in diameter than the second pair of rods.

10. The mass spectrometer as defined in claim 8 wherein the magnitude of $A_3$ is greater than 4% of the magnitude of $A_2$ and the first pair of rods are at least 2% larger in diameter than the second pair of rods.

11. The mass spectrometer as defined in claim 8 wherein the magnitude of $A_3$ is greater than 6% of the magnitude of $A_2$ and the first pair of rods are at least 4% larger in diameter than the second pair of rods.

12. The mass spectrometer as defined in claim 8 wherein the magnitude of $A_3$ is greater than 8% of the magnitude of $A_2$ and the first pair of rods are at least 8% larger in diameter than the second pair of rods.

13. The mass spectrometer as defined in claim 8 wherein the magnitude of $A_3$ is greater than 10% of the magnitude of $A_2$ and the first pair of rods are at least 14% larger in diameter than the second pair of rods.

14. The mass spectrometer as defined in claim 8 wherein the magnitude of $A_3$ is greater than 12% of the magnitude of $A_2$ and the first pair of rods are at least 20% larger in diameter than the second pair of rods.

15. A method of processing ions in a quadrupole mass filter having a quadrupole axis and a rod set having a plurality of rods, wherein each rod in the plurality of rods is equidistant from the quadrupole axis and is substantially cylindrical, the method comprising establishing and maintaining a two-dimensional substantially quadrupole field for processing ions within a selected range of mass to charge ratios, the field having a quadrupole harmonic with amplitude $A_2$ and a hexapole harmonic with amplitude $A_3$, wherein $A_3$ is greater than 0.1% of $A_2$;

determining a field centre of the two-dimensional substantially quadrupole field wherein the field centre is spaced from the quadrupole axis such that a dipole potential of the two-dimensional substantially quadrupole field is lower along the field centre than along the quadrupole axis; and, introducing ions to the field such that the ions are substantially centered around the field centre, wherein the field imparts stable trajectories to ions within the selected range of mass to charge ratios to retain such ions in the mass filter for transmission through the mass filter, and imparts unstable trajectories to ions outside of the selected range of mass to charge ratios to filter out such ions.

16. The method as defined in claim 15 wherein the dipole potential has a magnitude $A_1$ at the field centre, the magnitude of $A_1$ being less than 0.1% of the magnitude of $A_2$.

17. The method as defined in claim 15 further comprising detecting ions within the selected range of mass to charge ratios at an ion detection end of the field.

18. The method as defined in claim 15 wherein the magnitude of $A_3$ is greater than 1% and is less than 15% of the magnitude of $A_2$.

19. The method as defined in claim 18 wherein the magnitude of $A_3$ is greater than 1% and is less than 8% of the magnitude of $A_2$.

20. The method as defined in claim 15 wherein the plurality of rods comprises a first rod pair and a second rod pair, the second pair of rods being closer to one rod in the first pair of rods than to the other rod in the first pair of rods, and the rods of the second pair of rods being closer together than the rods of the first pair of rods, the method further comprising supplying a voltage $V_1$ to the first rod pair, the voltage $V_1$ being at least partially-AC and having a first DC component of the same polarity as the ions within the selected range of mass to charge ratios; and, supplying a voltage $V_2$ to the second rod pair, the voltage $V_2$ being at least partially-AC and having a second DC component of a different polarity than ions within the selected range of mass to charge ratios.

21. The method as defined in claim 20 wherein the substantially quadrupole field has an octopole harmonic with amplitude $A_4$, and the magnitude of $A_4$ is less than 0.1% of $A_2$.

22. The method as defined in claim 21 wherein the magnitude of $A_3$ is greater than 2% of the magnitude of $A_2$.

23. The method as defined in claim 21 wherein the magnitude of $A_3$ is greater than 4% of the magnitude of $A_2$.

24. The method as defined in claim 21 wherein the magnitude of $A_3$ is greater than 6% of the magnitude of $A_2$.

25. The method as defined in claim 21 wherein the magnitude of $A_3$ is greater than 8% of the magnitude of $A_2$.

26. The method as defined in claim 21 wherein the magnitude of $A_3$ is greater than 10% of the magnitude of $A_2$.

27. The method as defined in claim 21 wherein the magnitude of $A_3$ is greater than 12% of the magnitude of $A_2$.

28. A quadrupole electrode system for connection to a voltage supply means for providing an at least partially-AC potential difference within the quadrupole electrode system, the quadrupole electrode system comprising a quadrupole axis;

a first pair of rods, wherein each rod in the first pair of rods is spaced from and extends alongside the quadrupole axis;

a second pair of rods, wherein each rod in the second pair of rods is spaced from and extends alongside the quadrupole axis, wherein the first pair of rods and the second pair of rods are substantially cylindrical;

a voltage connection means for connecting at least one pair of the first pair of rods and the second pair of rods to the voltage supply means to provide the at least partially-AC potential difference between the first pair of rods and the second pair of rods such that in use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$, a hexapole harmonic with amplitude $A_3$, and an octopole harmonic with amplitude $A_4$ wherein the magnitude of $A_3$ is greater than 0.1% of the magnitude of $A_2$ and the magnitude of $A_4$ is less than 0.1% of the magnitude of $A_2$.

29. The quadrupole electrode system as defined in claim 28 wherein the magnitude of $A_3$ is greater than 1% of the magnitude of $A_2$.

30. The quadrupole electrode system as defined in claim 28 wherein in the quadrupole electrode system, (i) the second pair of rods is closer to one rod in the first pair of rods than to the other rod in the first pair of rods; (ii) the rods of the second pair of rods are closer together than the rods of the first pair of rods; (iii) all of the rods are equidistant from the quadrupole axis; and (iv) the first pair of rods are larger in diameter than the second pair of rods.

31. The quadrupole electrode system as defined in claim 30 wherein the magnitude of $A_3$ is greater than 2% of the magnitude of $A_2$ and the first pair of rods are at least 0.4% larger in diameter than the second pair of rods.

32. The quadrupole electrode system as defined in claim 30 wherein the magnitude of $A_3$ is greater than 4% of the magnitude of $A_2$ and the first pair of rods are at least 2% larger in diameter than the second pair of rods.

33. The quadrupole electrode system as defined in claim 30 wherein the magnitude of $A_3$ is greater than 6% of the magnitude of $A_2$ and the first pair of rods are at least 4% larger in diameter than the second pair of rods.

34. The quadrupole electrode system as defined in claim 30 wherein the magnitude of $A_3$ is greater than 8% of the magnitude of $A_2$ and the first pair of rods are at least 8% larger in diameter than the second pair of rods.

35. The quadrupole electrode system as defined in claim 30 wherein the magnitude of $A_3$ is greater than 10% of the magnitude of $A_2$ and the first pair of rods are at least 14% larger in diameter than the second pair of rods.

36. The quadrupole electrode system as defined in claim 30 wherein the magnitude of $A_3$ is greater than 12% of the magnitude of $A_2$ and the first pair of rods are at least 20% larger in diameter than the second pair of rods.

37. The quadrupole electrode system as defined in claim 30 wherein the voltage supply means is operable to provide a selected positive DC voltage to the first pair of rods relative to the second pair of rods for selection of positive ions; and, a selected negative DC voltage to the first pair of rods relative to the second pair of rods for selection of negative ions.

38. The quadrupole electrode system as defined in claim 30 wherein the magnitude of $A_3$ is greater than 1% and is less than 15% of the magnitude of $A_2$.

39. The quadrupole electrode system as defined in claim 30 wherein the magnitude of $A_3$ is greater than 1% and is less than 8% of the magnitude of $A_2$.

40. The quadrupole electrode system as defined in claim 30 further comprising an ion source for injecting ions substantially centered along a field center of the two-dimensional substantially quadrupole field, wherein the field center is spaced from the quadrupole axis such that a dipole potential of the two-dimensional substantially quadrupole field is lower along the field center than along the quadrupole axis.

41. The quadrupole electrode system as defined in claim 40 wherein i) the ion source is positioned relative to the quadrupole axis to inject ions along the field centre; and, ii) the dipole potential has a magnitude $A_1$ at the field centre, the magnitude of $A_1$ being less than 0.1% of the magnitude of $A_2$.

42. The quadrupole electrode system as defined in claim 40 wherein in the quadrupole electrode system, (i) the second pair of rods is closer to one rod in the first pair of rods than to the other rod in the first pair of rods; (ii) the rods of the second pair of rods are closer together than the rods of the first pair of rods; and, (iii) all of the rods are equidistant from the quadrupole axis.

43. A method of manufacturing a quadrupole electrode system for connection to a voltage supply means for providing an at least partially-AC potential difference within the quadrupole electrode system to generate a two-dimensional substantially quadrupole field for manipulating ions, the two-dimensional substantially quadrupole field having a quadrupole harmonic with amplitude $A_2$, the method comprising the steps of:

a) determining a hexapole harmonic with amplitude $A_3$ to be included in the field, wherein the magnitude of $A_3$ is greater than 0.1% of the magnitude of $A_2$; and b) installing a first pair of rods and a second pair of rods about a central axis such that the first pair of rods and the second pair of rods are spaced from and extend alongside the central axis;

wherein the first pair of rods and the second pair of rods are substantially cylindrical, and step b) comprises i) locating the second pair of rods closer to one rod in the first pair of rods than to the other rod in the first pair of rods to add the hexapole harmonic; and ii) making the first pair of rods larger than the second pair of rods to reduce an octopole harmonic of the field added by step b) i) such that an amplitude $A_4$ of the octopole harmonic is less than 0.1% of $A_2$.

44. The method as defined in claim 43 wherein step b) further comprises iii) positioning the rods of the second pair of rods to be closer together than the rods of the first pair of rods; and, (iv) positioning all of the rods to be equidistant from the quadrupole axis.

45. The method as defined in claim 43 wherein step b) i) comprises sufficiently displacing the second pair of rods about the central axis toward one rod in the first pair of rods such that the magnitude of $A_3$ is greater than 1% of the magnitude of $A_2$.

46. The method as defined in claim 45 wherein step b) i) comprises sufficiently displacing the second pair of rods about the central axis toward one rod in the first pair of rods such that the magnitude of $A_3$ is greater than 2% of the magnitude of $A_2$, and step b) ii) comprises making the first pair of rods at least 0.4% larger in diameter than the second pair of rods.

47. The method as defined in claim 45 wherein step b) i) comprises sufficiently displacing the second pair of rods about the central axis toward one rod in the first pair of rods such that the magnitude of $A_3$ is greater than 4% of the magnitude of $A_2$, and step b) ii) comprises making the first pair of rods at least 2% larger in diameter than the second pair of rods.

48. The method as defined in claim 45 wherein step b) i) comprises sufficiently displacing the second pair of rods about the central axis toward one rod in the first pair of rods such that the magnitude of $A_3$ is greater than 6% of the magnitude of $A_2$, and step b) ii) comprises making the first pair of rods at least 4% larger in diameter than the second pair of rods.

49. The method as defined in claim 45 wherein step b) i) comprises sufficiently displacing the second pair of rods about the central axis toward one rod in the first pair of rods such that the magnitude of $A_3$ is greater than 8% of the magnitude of $A_2$, and step b) ii) comprises making the first pair of rods at least 8% larger in diameter than the second pair of rods.

50. The method as defined in claim 45 wherein step b) i) comprises sufficiently displacing the second pair of rods about the central axis toward one rod in the first pair of rods such that the magnitude of $A_3$ is greater than 10% of the magnitude of $A_2$, and step b) ii) comprises making the first pair of rods at least 14% larger in diameter than the second pair of rods.

51. The method as defined in claim 45 wherein step b) i) comprises sufficiently displacing the second pair of rods about the central axis toward one rod in the first pair of rods such that the magnitude of $A_3$ is greater than 12% of the magnitude of $A_2$, and step b) ii) comprises making the first pair of rods at least 20% larger in diameter than the second pair of rods.

52. A method of processing ions in a quadrupole mass filter having a quadrupole axis and a rod set having a plurality of rods, wherein each rod in the plurality of rods is equidistant from the quadrupole axis and is substantially cylindrical, the method comprising establishing and maintaining a two-dimensional substantially quadrupole field for processing ions within a selected range of mass to charge ratios, the two-dimensional substantially quadrupole field having a quadrupole harmonic with amplitude $A_2$, a hexapole harmonic with amplitude $A_3$, and an octopole harmonic with amplitude $A_4$ wherein the magnitude of $A_3$ is greater than 0.1% of the magnitude of $A_2$ and the magnitude of $A_4$ is less than 0.1% of the magnitude of $A_2$; and, introducing ions to the field, wherein the field imparts stable trajectories to ions within the selected range of mass to charge ratios to retain such ions in the mass filter for transmission through the mass filter, and imparts unstable trajectories to ions outside of the selected range of mass to charge ratios to filter out such ions.

53. The method as defined in claim 52 wherein the magnitude of $A_3$ is greater than 2% of the magnitude of $A_2$.

54. The method as defined in claim 52 wherein the magnitude of $A_3$ is greater than 4% of the magnitude of $A_2$.

55. The method as defined in claim 52 wherein the magnitude of $A_3$ is greater than 6% of the magnitude of $A_2$.

56. The method as defined in claim 52 wherein the magnitude of $A_3$ is greater than 8% of the magnitude of $A_2$.

57. The method as defined in claim 52 wherein the magnitude of $A_3$ is greater than 10% of the magnitude of $A_2$.

58. The method as defined in claim 52 wherein the magnitude of $A_3$ is greater than 12% of the magnitude of $A_2$.

* * * * *